US009601831B2

(12) United States Patent
Watanabe et al.

(10) Patent No.: US 9,601,831 B2
(45) Date of Patent: Mar. 21, 2017

(54) RADIO DEVICE

(75) Inventors: Takashi Watanabe, Nara (JP); Hiroyuki Uno, Ishikawa (JP); Masaki Sugiyama, Kyoto (JP); Yoshiyuki Yokoajiro, Nara (JP); Yoshishige Yoshikawa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 176 days.

(21) Appl. No.: 13/580,637

(22) PCT Filed: Nov. 24, 2011

(86) PCT No.: PCT/JP2011/006534

§ 371 (c)(1),
(2), (4) Date: Aug. 22, 2012

(87) PCT Pub. No.: WO2012/070242

PCT Pub. Date: May 31, 2012

(65) Prior Publication Data

US 2012/0313824 A1 Dec. 13, 2012

(30) Foreign Application Priority Data

Nov. 25, 2010 (JP) ..... 2010-261960
Feb. 4, 2011 (JP) ..... 2011-022372

(51) Int. Cl.
*H01Q 1/52* (2006.01)
*H01Q 9/04* (2006.01)
(Continued)

(52) U.S. Cl.
CPC ..... *H01Q 9/0421* (2013.01); *H01Q 1/2233* (2013.01); *H01Q 1/48* (2013.01); *H01Q 1/52* (2013.01)

(58) Field of Classification Search
CPC ..... H01Q 1/38
(Continued)

(56) References Cited

U.S. PATENT DOCUMENTS 3,502,785 A * 3/1970 Nickola ..... 174/38
5,298,894 A * 3/1994 Cerny et al. ..... 340/870.02
(Continued)

FOREIGN PATENT DOCUMENTS

CN 2864845 Y 1/2007
CN 201134510 Y 10/2008
(Continued)

OTHER PUBLICATIONS

Supplementary European Search Report in corresponding European Application No. 11 84 2538, dated Sep. 5, 2013, 7 pages.
(Continued)

*Primary Examiner* — Graham Smith
*Assistant Examiner* — Andrea Lindgren Baltzell
(74) *Attorney, Agent, or Firm* — Brinks Gilson & Lione

(57) ABSTRACT

A radio device of the present invention includes a radiation conductor which converts a radio frequency signal into an electric wave and radiates the electric wave; a circuit board electrically connected to the radiation conductor and incorporating an electric circuit for supplying the radio frequency signal to the radiation conductor a planar grounded conductor electrically connected to the electric circuit on the circuit board and placed such that the grounded conductor faces the radiation conductor, the grounded conductor constituting a ground of the radiation conductor; and a resin-made casing for accommodating the radiation conductor, the circuit board and the grounded conductor; wherein the grounded conductor, the circuit board and the radiation conductor are placed in this order in a thickness direction of the circuit board.

16 Claims, 17 Drawing Sheets

(51) Int. Cl.
*H01Q 1/48* (2006.01)
*H01Q 1/22* (2006.01)

(58) Field of Classification Search
USPC ..... 343/700 MS
See application file for complete search history.

(56) References Cited

U.S. PATENT DOCUMENTS

| | | | | |
|---|---|---|---|---|
| 6,239,753 | B1 | 5/2001 | Kado et al. | |
| 2003/0052827 | A1 | 3/2003 | Umehara et al. | |
| 2003/0169206 | A1 | 9/2003 | Egawa | |
| 2004/0130494 | A1 | 7/2004 | Fukushima et al. | |
| 2006/0214849 | A1 | 9/2006 | Fabrega-Sanchez et al. | |
| 2008/0074283 | A1* | 3/2008 | Verkleeren | G01D 4/002 340/870.02 |
| 2008/0316115 | A1* | 12/2008 | Hill | H01Q 1/243 343/702 |

FOREIGN PATENT DOCUMENTS

| | | | |
|---|---|---|---|
| EP | 0757405 | A1 | 2/1997 |
| EP | 2302812 | | 3/2011 |
| JP | 05-018138 | U | 3/1993 |
| JP | 09-027092 | A | 1/1997 |
| JP | H10-41741 | | 2/1998 |
| JP | 1 0-31 321 2 | A | 11/1998 |
| JP | 10-313212 | A | 11/1998 |
| JP | H11-86174 | | 3/1999 |
| JP | 2003-092510 | A | 3/2003 |
| JP | 3467164 | B2 | 8/2003 |
| JP | 2004-320814 | A | 11/2004 |
| JP | 2005-012743 | | 1/2005 |
| JP | 2006-245868 | | 9/2006 |
| JP | 2006-319496 | A | 11/2006 |
| JP | 2008-288931 | | 11/2008 |
| WO | WO 2006/120996 | A1 | 11/2006 |
| WO | WO 2010/023778 | | 3/2010 |
| WO | WO 2010/073454 | A1 | 7/2010 |

OTHER PUBLICATIONS

International Search Report for International Application No. PCT/JP2011/006534, dated Mar. 6, 2012, 2 pages.
Office Action and Search Report, and partial translation thereof, in corresponding Chinese Application No. 201180007927.2, dated Jul. 3, 2014, 10 pages.
Office Action and Search Report, and partial English language translation thereof, in corresponding Chinese Application No. 201180007927.2, dated Feb. 2, 2015, 10 pages.
Communication pursuant to Article 94(3) EPC in corresponding European Application No. 11 842 538.8, dated Jul. 21, 2015, 7 pages.

* cited by examiner

RADIO DEVICE

This application is a 371 application of PCT/JP2011/006534 having an international filing date of Nov. 24, 2011, which claims priority to JP2010-261960 filed Nov. 25, 2010 and JP2011-022372 filed Feb. 4, 2011, the entire contents of which are incorporated herein by reference.

TECHNICAL FIELD

The present invention relates to a radio device, and particularly relates to a radio device attached to a meter box accommodating a gas meter, a power meter, a water meter, or the like.

BACKGROUND ART

In recent years, an automatic meter reading system has been introduced, in which a meter attached to a building structure such as a house measures a usage amount of gas, electricity, or tap water and measurement data is gathered by radio (wireless) communication. In the automatic meter reading system, there is a need for a small-sized radio device having a built-in antenna because of easiness of attachment to the meter box.

As an example of the above stated radio device, there is a radio device including a board-mounted planar antenna in which a grounded conductor plate and a short-circuit conductor in a radiation conductor section are connected together via a wiring pattern in a printed circuit board. In this radio device, the grounded conductor plate is used as a ground of the radiation conductor section and is provided between the radiation conductor plate and the printed circuit board (e.g., see Patent Literature 1).

In a radio communication device, an elongated conductor section is provided above a printed board such that the elongated conductor section faces the printed board. A ground pattern is placed on the printed board, and a portion of the ground pattern which faces the elongated conductor section is removed. The elongated conductor section is electrically connected to the ground pattern via a grounded conductor section and electrically connected to a power feeding point of a printed board via a power feeding conductor section. Because of this, in the vicinity of the grounded conductor section, the ground pattern is disposed between the printed board and the elongated conductor section (e.g., see Patent Literature 2).

In a radio device for automatic meter reading including the radio device, the radio device and a planar antenna are accommodated into a resin-made casing, and the radio device is disposed inside a metal-made casing. The planar antenna is connected to the metal-made casing via a metal connecting section, and the metal-made casing is used as a ground of the planar antenna. A power feeding section is provided between the metal-made casing and the planar antenna (e.g., see Patent Literature 3).

Patent Literature 1: Japanese Laid-Open Patent Application Publication No. Hei. 10-313212

Patent Literature 2: Japanese Laid-Open Patent Application Publication No. 2003-92510

Patent Literature 3: Japanese Laid-Open Patent Application Publication No. Hei. 9-27092

SUMMARY OF THE INVENTION

Technical Problem

However, if a size of the ground corresponding to the radiation conductor is small with respect to a wavelength of an operating frequency of the antenna, the antenna is affected by metal present in the vicinity thereof, which degrades antenna characteristics such as a gain or a radiation efficiency.

For example, in the conventional radio device including the board-mounted planar antenna, if a size of the grounded conductor which serves as the ground of the radiation conductor is great, degradation of the antenna characteristics which would be caused by the metal can be prevented, but the size of the radio device increases.

On the other hand, if the size of the ground of the radiation conductor is small, the antenna characteristics are degraded because of the influence of the metal in the vicinity thereof. The radio device including the board-mounted planar antenna is attached to a metal surface in such a manner that the printed circuit board, the grounded conductor section, and the radiation conductor section are placed in this order on the metal surface. In this way, the printed circuit board is placed between the grounded conductor section and the metal surface, and thereby a distance between the grounded conductor section and the metal surface increases. Since an impedance of the antenna increases because of the influence of the metal surface, the antenna characteristics are degraded.

The problem similar to that associated with the conventional radio device including the board-mounted planar antenna also occurs in a conventional radio communication device.

On the other hand, in a configuration in which the conventional radio device for automatic meter reading is attached to the metal surface, a size of the metal-made casing used as the ground of the planar antenna is greater with respect to a size corresponding to a wavelength of a radio frequency (RF) signal supplied to the antenna. Because of this, the planar antenna is less likely to be affected by the metal surface. However, the metal-made casing of a great size is required to be placed in the vicinity of the planar antenna, which increases the size of the radio device, the number of components and manufacturing cost.

The present invention has been made to solve the above described problems, and an object of the present invention is to provide a small-sized radio device which can suppress degradation of antenna characteristics which would be caused by metal.

Solution to Problem

According to an aspect of the present invention, a radio device comprises a radiation conductor which converts a radio frequency signal into an electric wave and radiates the electric wave; a circuit board electrically connected to the radiation conductor and incorporating an electric circuit for supplying the radio frequency signal to the radiation conductor; a planar grounded conductor electrically connected to the electric circuit on the circuit board and placed such that the grounded conductor faces the radiation conductor, the grounded conductor constituting a ground of the radiation conductor; and a resin-made casing for accommodating the radiation conductor, the circuit board and the grounded conductor; wherein the grounded conductor, the circuit board and the radiation conductor are placed in this order in a thickness direction of the circuit board.

Advantageous Effects of the Invention

The present invention has the above described configuration, and can achieve an advantage that it is possible to provide a small-sized radio device capable of suppressing degradation of antenna characteristics which would be caused by metal can be suppressed.

The above and further objects, features and advantages of the present invention will more fully be apparent from the following detailed description of preferred embodiments with accompanying drawings.

DETAILED DESCRIPTION OF THE PREFERRED EMBODIMENTS

Figure 1:
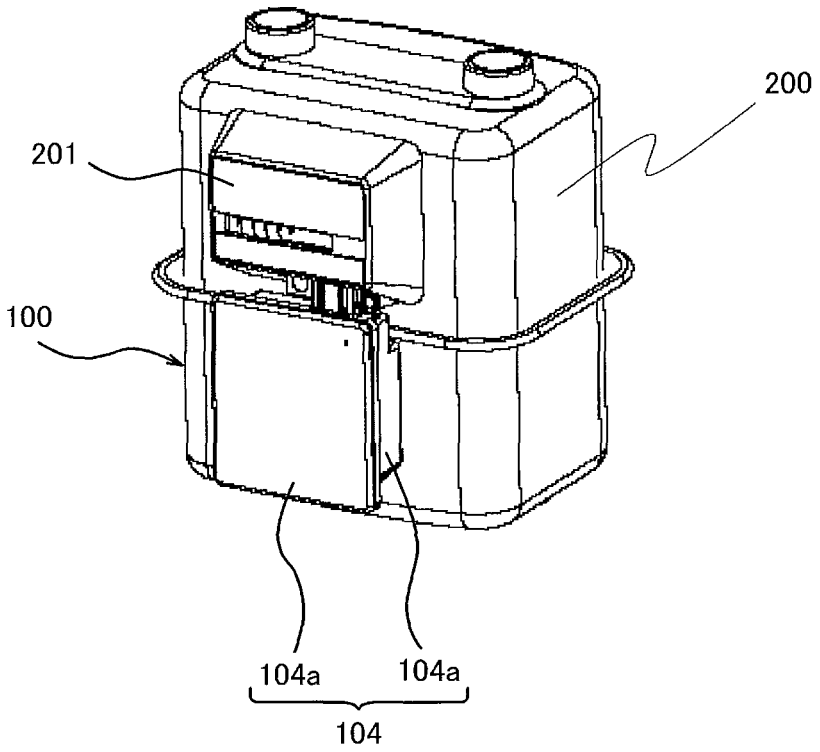
FIG. 1 is a perspective view showing a meter box attached with a radio device according to Embodiment 2 of the present invention.

According to an aspect of the present invention, a radio device comprises a radiation conductor which converts a radio frequency signal into an electric wave and radiates the electric wave; a circuit board electrically connected to the radiation conductor and incorporating an electric circuit for supplying the radio frequency signal to the radiation conductor; a planar grounded conductor electrically connected to the electric circuit on the circuit board and placed such that the grounded conductor faces the radiation conductor, the grounded conductor constituting a ground of the radiation conductor; and a resin-made casing for accommodating the radiation conductor, the circuit board and the grounded conductor; wherein the grounded conductor, the circuit board and the radiation conductor are placed in this order in a thickness direction of the circuit board.

In accordance with this configuration, since the grounded conductor, the circuit board and the radiation conductor are arranged in this order in the thickness direction of the circuit board, and the grounded conductor constitutes the ground of the radiation conductor. Because of this, a distance between the grounded conductor and the radiation conductor can be increased as great as possible, a frequency bandwidth of an antenna can be expanded, and excellent antenna characteristics can be attained.

In addition, in a state in which the radio device having the above configuration is attached to a metal surface, the grounded conductor of the components of the radio device is made closest to the metal surface. Because of this, a distance between the grounded conductor and the metal surface is small, and they are electrically coupled together. This can increase an effective area of the antenna. Therefore, even in the radio device having a small size with respect to a wavelength of an operating frequency, degradation of a radiation efficiency which would be caused by metal can be prevented.

In the radio device, the grounded conductor and a surface of the casing which faces the grounded conductor may be placed in parallel with each other.

In accordance with this configuration, in a state in which the casing is attached in parallel with the metal surface such that the surface of the casing which faces the grounded conductor faces the metal surface, the grounded conductor is placed in parallel with the metal surface. Because of this, the grounded conductor can be made close to the metal surface evenly, the entire of the grounded conductor can be electrically coupled to the metal surface, and degradation of the radiation efficiency can be suppressed more effectively.

In the radio device, the radiation conductor, the grounded conductor and the circuit board may be placed in parallel with each other.

In accordance with configuration, since the radiation conductor, the grounded conductor and the circuit board are placed in parallel with each other, a distance between the radiation conductor and the grounded conductor can be reduced, and therefore, the size of the radio device can be reduced.

In the radio device, the radiation conductor may comprise a planar conductor element.

In this case, the radiation conductor may comprise a planar inverted-F antenna.

In accordance with this configuration, since the planar conductor element such as the planar inverted antenna is used as the radiation conductor, the size of the radiation conductor can be reduced with respect to the wavelength of the operating frequency.

The radio device may further comprise a power feeding terminal which electrically connects the electric circuit on the circuit board to the radiation conductor and feeds the radio frequency signal from the circuit board to the radiation conductor; a short-circuit terminal which electrically connects a ground section of the electric circuit on the circuit board to the radiation conductor and electrically grounds the radiation conductor on the ground section of the electric circuit; and a ground terminal which electrically connects the grounded conductor to the ground section of the electric circuit on the circuit board and is placed on the ground section, in the vicinity of a location at which the short-circuit terminal is grounded on the ground section.

In accordance with this configuration, the radiation conductor is electrically connected to the grounded conductor via the short-circuit terminal and the ground terminal, and the grounded conductor is not directly connected to the radiation conductor. Because of this, since the grounded conductor is away from the metal surface in a state in which the grounded conductor is attached to the metal surface, the antenna is less likely to be affected by the metal, and thus, degradation of the radiation efficiency is suppressed.

Since the ground terminal is connected to the ground section of the electric circuit on the circuit board in the vicinity of the short-circuit terminal, a distance over which a current flows between the ground terminal and the short-circuit terminal is short. Therefore, a power loss can be lessened, and reduction of radiation efficiency can be prevented.

In the radio device, the radiation conductor may comprises a wire formed on a main surface of a pair of main surfaces of the circuit board, the main surface being more distant from the grounded conductor.

In accordance with this configuration, since the wire included in the circuit board is used as the radiation conductor, the number of components can be reduced, the size of the radio device can be reduced, and cost of the manufacturing cost can be reduced.

In the radio device, the radiation conductor may comprise a linear conductor element.

In accordance with this configuration, by using the radiation conductor comprising the linear conductor element, antenna characteristics similar to those in the case of using the planar conductor element are attained.

In the radio device, a conductor layer which is the grounded conductor may be provided on a main surface of a pair of main surfaces of the circuit board, the main surface being more distant from the radiation conductor.

In the radio device, a layer including the electric circuit may be provided on a main surface of the pair of main surfaces of the circuit board, the main surface being closer to the radiation conductor.

In accordance with this configuration, the conductor layer is formed as the grounded conductor in the circuit board, and the conductor layer, the layer including the electric circuit, and the radiation conductor are stacked together in this order and joined together. Because of this, in a state in which the radio device having the above configuration is attached to the metal surface, the conductor layer of the components of the radio device is made closest to the metal surface. Because of this, a distance between the conductor layer and the metal surface is small and they are electrically coupled together. This can increase an effective area of the antenna. Therefore, even in the radio device having a small size with respect to a wavelength of an operating frequency, degradation of the radiation efficiency which would be caused by metal can be prevented.

Since the conductor layer of the circuit board is used as the ground of the radiation conductor, the size of the radio device can be reduced, the number of components can be reduced, and low cost can be achieved.

In the radio device, the casing may include a container-shaped body having an opening and a lid closing the opening of the body. A linear conductor element may be placed on one of the body and the lid such that the linear conductor element encloses the opening. The radiation conductor, the circuit board and the grounded conductor may be accommodated into the body such that the radiation conductor is positioned in the vicinity of the opening.

In accordance with this configuration, since the radiation conductor is placed in the vicinity of the opening of the first casing and the linear conductor element encloses the opening, the linear conductor element is positioned in the vicinity of the radiation conductor. Since the linear conductor element and the radiation conductor can be electrically coupled together, a high radiation efficiency is attained, even in the radio device having a small size with respect to the wavelength of the frequency of the radiated electric wave.

Hereinafter, embodiments of the present invention will be described with reference to the drawings.

Hereinafter, throughout the drawings, the same or corresponding components are designated by the same reference symbols and repetitive description thereof will not be given.

Embodiment 1

Figure 17:
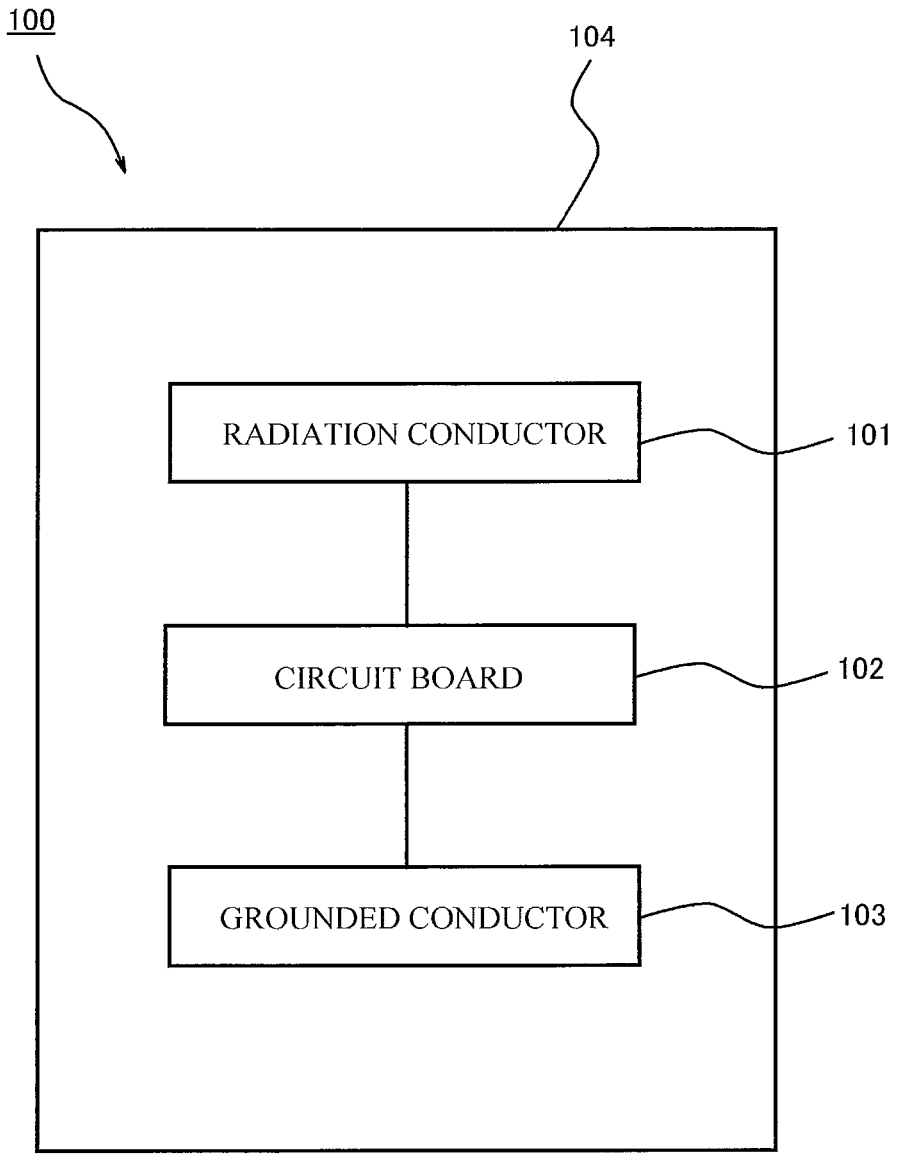
FIG. 17 is a block diagram showing the configuration of a radio device according to Embodiment 1 of the present invention.

FIG. 17 is a block diagram showing the configuration of a radio device 100 according to Embodiment 1 of the present invention.

The radio device 100 includes a radiation conductor 101, a circuit board 102 and a grounded conductor 103.

The radiation conductor 101 converts a radio frequency (RF) signal into an electric wave and radiates the electric wave.

An electric circuit for radio communication is mounted on the circuit board 102. The electric circuit includes, for example, integrated circuits. The integrated circuit for radio (wireless) communication is electrically connected to the radiation conductor 101, and supplies the radio frequency (RF) signal to the radiation conductor 101 according to data from the integrated circuit for gathering data.

The grounded conductor 103 is a planar and is electrically connected to a ground section of the electric circuit on the circuit board 102. The grounded conductor 103 faces the radiation conductor 101 and constitutes a ground of the radiation conductor 101.

The radiation conductor 101, the circuit board 102 and the grounded conductor 103 are arranged in this order in a thickness direction of the circuit board 102 and are accommodated into a resin-made casing 104.

When data such as measurement values of a meter are obtained in the radio device 100 having the above configuration, the integrated circuit for radio communication creates a radio frequency (RF) signal based on this data and supplies the RF signal to the radiation conductor 101. The radiation conductor 101 converts the radio frequency (RF) signal into the electric wave and radiates the electric wave.

Since the radiation conductor 101, the grounded conductor 103 and the circuit board 102 are arranged in this order in the thickness direction of the circuit board 102 in this way, inside the casing 104, in Embodiment 1, the radiation conductor 101 and the grounded conductor 103 are placed to be spaced apart from each other with the greatest possible distance, inside the casing 104. Since the distance between the radiation conductor 101 and the grounded conductor 103 is set greater, a frequency bandwidth of an antenna is expanded, and therefore excellent antenna characteristics are attained.

When the radio device 100 is placed on a metal surface such that the grounded conductor 103 is positioned on the metal surface side, the grounded conductor 103 is closer to the metal surface. Because of this, the grounded conductor 103 and the metal surface are metallically joined together, and thereby the metal surface functions as a ground of the radiation conductor 101, in addition to the grounded conductor 103. Therefore, even if a size of the grounded conductor 103 is small with respect to the wavelength of the operating frequency, an impedance of the antenna will not increase. As a result, even the radio device 100 of a small size can suppress degradation of the antenna characteristics which would be caused by the metal.

Embodiment 2

FIG. 1 is a perspective view showing a meter box 200 attached with the radio device 100 device according to Embodiment 2 of the present invention.

The meter box 200 is a box accommodating a meter for measuring a usage amount of gas, electricity, tap water, etc. The meter box 200 is made of metal. A display section 201 is provided on a front wall of the meter box 200. The radio device 100 is attached to the front wall of the meter box 200.

As the radio device 100 according to Embodiment 2, the specific structure or the like of the radiation conductor 101, the circuit board 102 and the grounded conductor 103 of Embodiment 1 are specifically illustrated. The radio device 100 is a device which transmits, for example, data measured by the meter to a meter reading terminal carried by an operator of a supplier of gas, electricity, tap water, etc., via radio (wireless) communication. The radio device 100 includes a casing 104 which has a thin rectangular-parallelepiped shape and is attached to the metal box 200 by an attaching member such as screws, a double-faced tape, or a hook. The obverse surface of a second casing 104*b* of the casing 104 is oriented in the same direction as the front wall of the meter box 200, while the first casing 104*a* faces the front wall of the meter box 200. The first casing 104*a* and the front wall of the meter box 200 may be in contact with each other or may be spaced apart from each other with a small distance. Note that the distance between them may be a distance which allows the grounded conductor 103 and the front wall of the meter box 200 to be positioned in close proximity to each other and metallically joined together.

The radio device 100 includes a circuit and program for obtaining measurement values from the meter box 200. A method of obtaining the measurement values is not particularly limited. For example, a pulse waveform output from the meter box 200 is counted and a flow rate of the gas or the like is measured by the radio device 100, thereby obtaining the measurement value. A mechanism including a magnet displaceable according to the flow rate is incorporated into the meter box 200, and the radio device 100 detects the displacement of the magnet, thereby obtaining the measurement value. In addition, a unit for converting a movement of the magnet displaceable according to the flow rate into a pulse waveform is provided, and the radio device 100 counts the pulse waveform output from the unit, thereby obtaining the measurement value. The radio device 100 including the mechanism for counting the flow rate may be electrically connected to the meter box 200 by means of a harness or the like and may obtain the pulse waveform via the harness. Or, the radio device 100 may detect the pulse waveform by using a reed switch which is not connected to the meter box 200.

Figure 2:
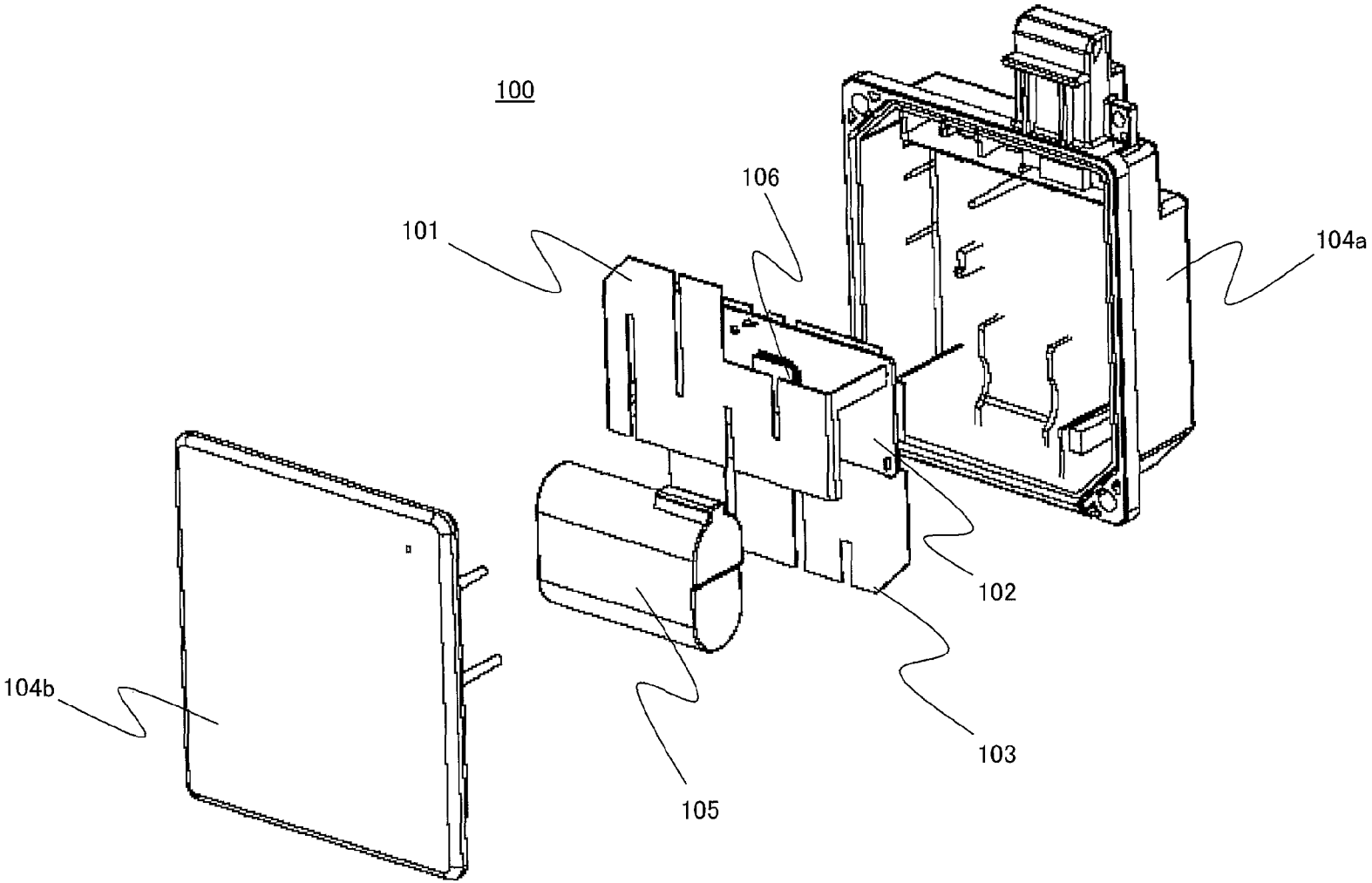
FIG. 2 is an exploded perspective view showing the radio device according to Embodiment 2 of the present invention.
Figure 3:
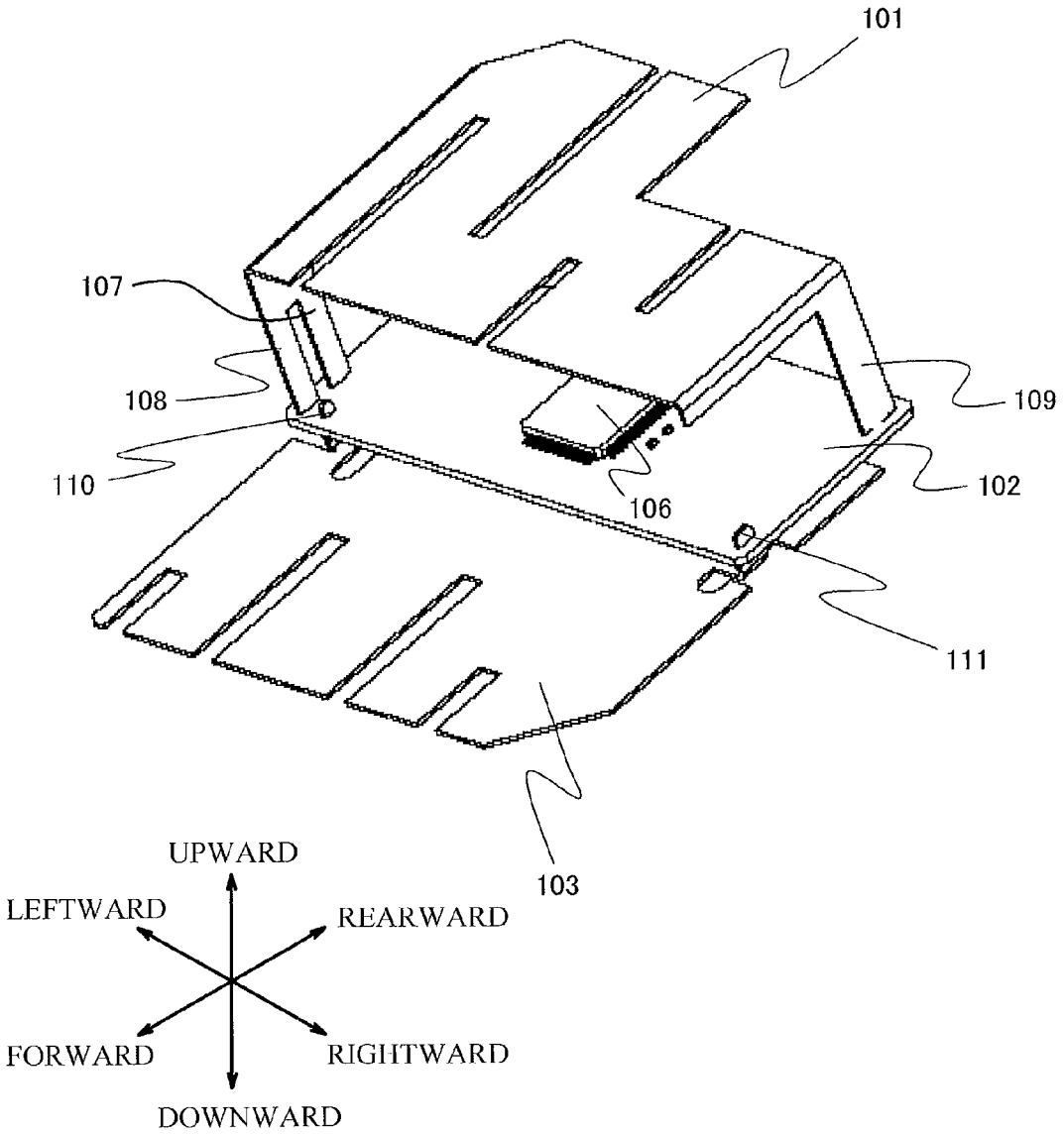
FIG. 3 is a perspective view showing a radiation conductor, a circuit board and a grounded conductor in the radio device according to Embodiment 2 of the present invention.
Figure 4:
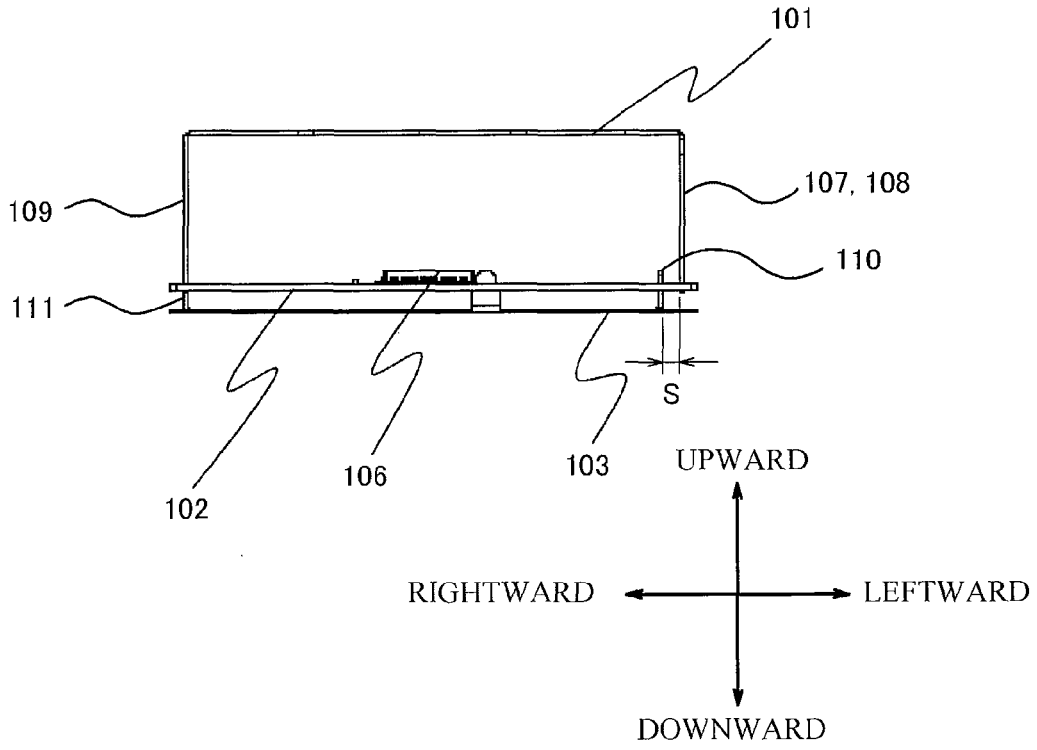
FIG. 4 is a schematic view showing the radiation conductor, the circuit board and the grounded conductor in the radio device according to Embodiment 2 of the present invention, when viewed from rearward.
Figure 5:
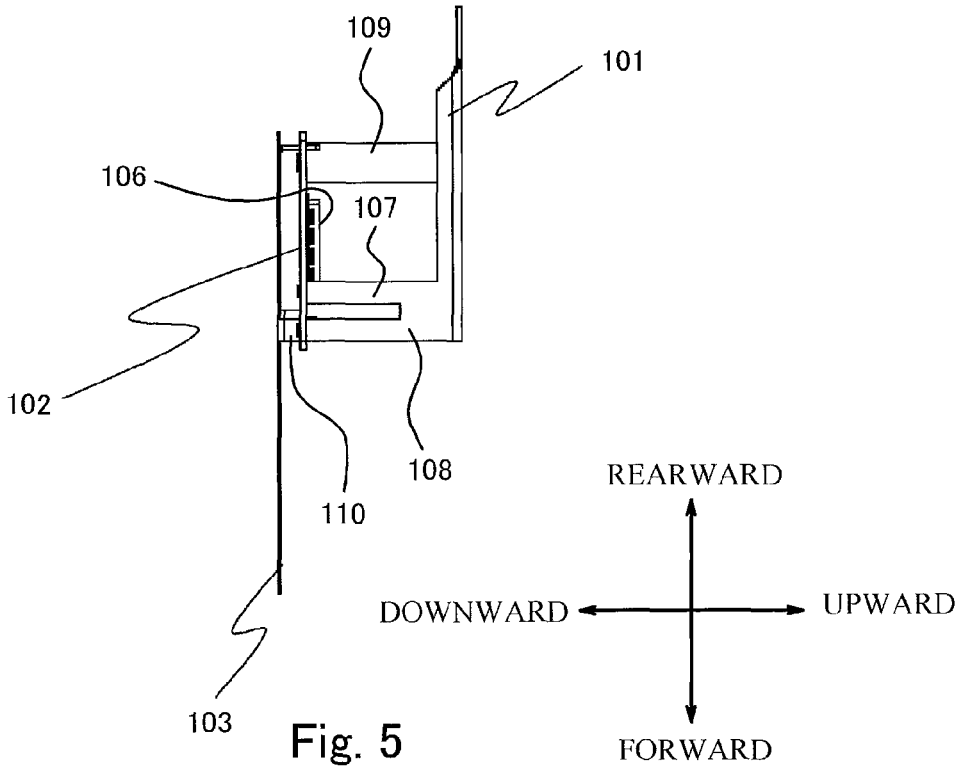
FIG. 5 is a schematic view showing the radiation conductor, the circuit board and the grounded conductor in the radio device according to Embodiment 2 of the present invention, when viewed from leftward.
Figure 6:
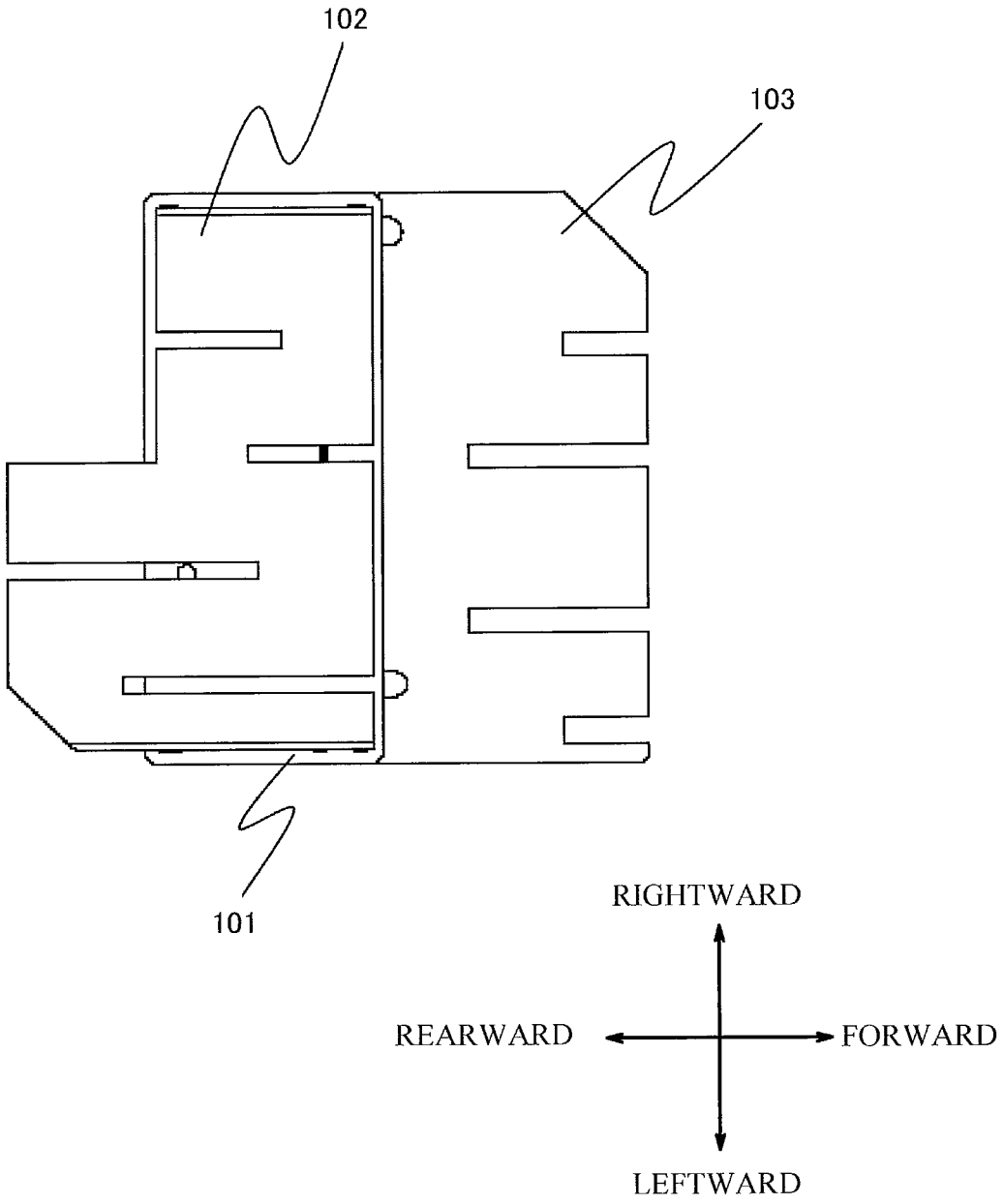
FIG. 6 is a schematic view showing the radiation conductor, the circuit board and the grounded conductor in the radio device according to Embodiment 2 of the present invention, when viewed from above.

FIG. 2 is an exploded perspective view of the radio device 100. FIG. 3 is a perspective view showing the radiation conductor 101, the circuit board 102 and the grounded conductor 103 in the radio device 100. FIG. 4 is a schematic view showing the radiation conductor 101, the circuit board 102 and the grounded conductor 103, when viewed from rearward. FIG. 5 is a schematic view showing the radiation conductor 101, the circuit board 102 and the grounded conductor 103, when viewed from leftward. FIG. 6 is a schematic view showing the radiation conductor 101, the circuit board 102 and the grounded conductor 103, when viewed from above. Directions of upward, downward, forward, rearward, leftward, and rightward are indicated by arrows shown in FIGS. 3 to 6.

The casing 104 is made of resin having electric insulation, such as polypropylene or ABS. The casing 104 includes the first casing 104*a* and the second casing 104*b*. The first casing 104*a* has a container shape having an opening. In the present embodiment, the first casing 104*a* has the rectangular-parallelepiped shape having an open surface. The second casing 104*b* is configured to cover (close) the opening of the first casing 104*a*, and has, for example, a planar shape. The first casing 104*a* and the second casing 104*b* are coupled (joined) together by means of bonding, fusion-bonding, screws, etc., thereby forming the casing 104. A battery 105 and the circuit board 102 are built into the casing 104.

The battery 105 is an electric power supply for supplying electric power to electronic components mounted on the circuit board 102, and the like. The battery 105 is connected to an electric circuit on the circuit board 102 via wires (not shown), or the like and positioned closer to the second casing 104*b* than the circuit board 102.

In the circuit board 102, electronic components of the electric circuit are mounted on the surface of an insulator board (substrate). The electronic components are connected to each other via wires such as copper foil or silver foil. The electronic components include an integrated circuit 106 for radio communication (hereinafter referred to as "radio circuit"), and an integrated circuit (hereinafter referred to as a "control circuit") for controlling the components. A region of the wires on the board in which the electronic components are not mounted serves as a ground section of the electric circuit (circuit board).

The radio circuit 106 includes a transmission circuit for transmitting data via radio communication, a receiving circuit for processing the data received via the radio communication, a matching circuit connecting the transmission circuit to the receiving circuit, etc.

The radiation conductor 101 and the grounded conductor 103 are electrically connected to the electric circuit on the circuit board 102.

The radiation conductor 101 converts the radio frequency (RF) signal from the circuit board 102 into the electric wave and radiates the electric wave, or receives the electric wave from outside and converts the electric wave into the radio frequency (RF) signal. The radiation conductor 101 has a flat plate shape and comprises an electric conductor of copper or the like. The radiation conductor 101 is provided with a plurality of slits. The number, size, locations and the like of the slits are adjusted according to a resonant frequency of the electric wave to be transmitted and received. A power feeding terminal 107 and a short-circuit terminal 108 are placed on one end portion of the radiation conductor 101, while a first support section 109 is placed on the other end portion of the radiation conductor 101.

For example, the power feeding terminal 107 and the short-circuit terminal 108 are formed integrally with the radiation conductor 101. The radiation conductor 101, the power feeding terminal 107 and the short-circuit terminal 108 are formed by bending a metal plate having a shape of the radiation conductor 101, the power feeding terminal 107 and the short-circuit terminal 108. Note that the radiation conductor 101, the power feeding terminal 107 and the short-circuit terminal 108 may be separate from each other so long as the power feeing terminal 107 and the short-circuit terminal 108 are electrically connected to the radiation conductor 101. In this case, the power feeding terminal 107 and the short-circuit terminal 108 are connected to the radiation conductor 101 by means of fusion-bonding, or the like.

The power feeding terminal 107 extends in a direction perpendicular to the radiation conductor 101. The power feeding terminal 107 electrically connects the radiation conductor 101 to the radio circuit 106 on the circuit board 102 and feeds the radio frequency (RF) signal from the radio circuit 106 to the radiation conductor 101.

The short-circuit terminal 108 extends in a direction perpendicular to the radiation conductor 101 and in parallel with the power feeding terminal 107. The short circuit terminal 108 electrically grounds the radiation conductor 101 on the ground section formed by wires in the electric circuit on the circuit board 102. The width of the power feeding terminal 107, the width of the short-circuit terminal 108, and a distance between the power feeding terminal 107 and the short-circuit terminal 108 are set to values which allow impedance matching between the radiation conductor 101 and the radio circuit 106.

The power feeding terminal 107 is connected to the radio circuit 106 by soldering, while the short-circuit terminal 108 is connected to the ground section of the circuit board 102 by soldering. However, the connecting method is not limited to this so long as these components are electrically connected to each other. For example, these components may be connected to each other via screws, connectors, and the like.

The first support section 109, together with the short-circuit terminal 108 and the power feeding terminal 107, supports the radiation conductor 101 on the circuit board 102. The first support section 109 has an L-shape and is made of electrically insulative resin, or the like. The first support section 109 extends from the radiation conductor 101 in a direction perpendicular to the radiation conductor 101 and in parallel with the short-circuit terminal 108 and the power feeding terminal 107. The first support section 109 is provided on the radiation conductor 101 in a location which is an opposing corner of a location at which the short-circuit terminal 108 and the power feeding terminal 107 are provided on the radiation conductor 101. Thus, the radiation conductor 101 faces the circuit board 102 and is placed in parallel with the circuit board 102 such that the radiation conductor 101 is spaced apart from the circuit board 102 and in parallel with the circuit board 102.

The grounded conductor 103 faces the radiation conductor 101 and constitutes the ground of the radiation conductor 101. The grounded conductor 103 has a flat plate shape and comprises an electric conductor of copper or the like. The grounded conductor 103 is located at an opposite side of the radiation conductor 101 with respect to the circuit board 102 interposed between them. A ground (earth) terminal 110 is placed on one end portion of the grounded conductor 103 and a second support section 111 is placed on the other end portion of the grounded conductor 103.

The ground terminal 110 extends in a direction perpendicular to the grounded conductor 103. The ground terminal 110 electrically connects the grounded conductor 103 to the ground section of the electric circuit on the circuit board 102. This allows the ground section of the circuit board 102 and the grounded conductor 103 to have equal electric potentials.

The ground terminal 110 is connected to the ground section of the circuit board 102, in a location which is in the vicinity of a location at which the short-circuit terminal 108 is grounded on the ground section. Because of this, the short-circuit terminal 108 and the ground terminal 110 are not continuous but are spaced apart from each other. A distance "s" (FIG. 11) between the location at which the short-circuit terminal 108 is connected to the circuit board 102 and the location at which the ground terminal 110 is connected to the circuit board 102 is desirably 1/20 or less of the wavelength of the electric wave radiated from the radiation conductor 101.

The second support section 111 supports the grounded conductor 103 on the circuit board 102, together with the ground terminal 110. The second support section 111 is made of electrically insulative resin or the like, and is not electrically connected to the ground terminal 110. The second support section 111 extends from the radiation conductor 101 in a direction perpendicular to the radiation conductor 101 and parallel to the ground terminal 110. The second support section 111 is provided on the radiation conductor 101 in a location which is an opposing corner of a location at which the short-circuit terminal 108 and the power feeding terminal 107 are provided on the radiation conductor 101. Thus, the grounded conductor 103 is placed such that the grounded conductor 103 faces the circuit board 102, extends in parallel with the circuit board 102, and is spaced apart from the circuit board 102.

In the above described manner, a planar inverted-F antenna is constructed, using the grounded conductor 103 as the ground of the radiation conductor 101. As shown in FIG. 2, the planar inverted-F antenna is placed inside the first casing 104*a* such that the grounded conductor 103 faces the back surface of the first casing 104*a* and extends in parallel with the back surface of the first casing 104*a*, and the battery 105 is placed in front of the planar inverted-F antenna. As shown in FIG. 1, the opening of the first casing 104*a* is closed by the second casing 104*b*, thereby forming the radio device 100. In the radio device 100, the back surface of the first casing 104*a*, the grounded conductor 103, the circuit board 102, the radiation conductor 101 and the obverse surface of the second casing 104*b* face each other and extend in parallel with each other. And, the radio device 100 is attached to the meter box 200 such that the back surface of the first casing 104*a* faces the obverse wall portion of the meter box 200 and extends in parallel with the obverse wall portion. A distance "d" (see FIG. 12B) between the back surface of the first casing 104*a* and the obverse wall portion of the meter box 200 is desirably set to 1/50 wavelength or less to allow the grounded conductor 103 and the meter box 200 to be strongly coupled together by electrostatic capacitance, as will be described later.

When data of a measurement value is obtained from the meter box 200, the radio circuit 106 provides the radio frequency (RF) signal to the radiation conductor 101 via the power feeding terminal 107. The radiation conductor 101 converts the radio frequency (RF) signal into the electric wave and radiates the electric wave. In this case, since the distance between the grounded conductor 103 and the front wall of the meter box 200 is very small, the grounded conductor 103 is electrically coupled to the meter box 200. Thereby, the meter box 200 acts as the ground of the radiation conductor 101 like the grounded conductor 103, and hence, the ground of the radiation conductor 101 is sufficiently greater relative to the wavelength of the electric wave. Because of this, even when the metal-made meter box 200 is present in the vicinity of the radiation conductor 101, an impedance of the planar inverted-F antenna does not increase and the antenna characteristics such as the gain and the radiation efficiency will not be degraded. To the contrary, in some cases, the radiation efficiency of the electric wave in the case where the radio device 100 is placed in close proximity to the metal-made box 200 is higher than the radiation efficiency of the electric wave in the case of the radio device 100 as the single unit, as will be described later.

Figure 7A:
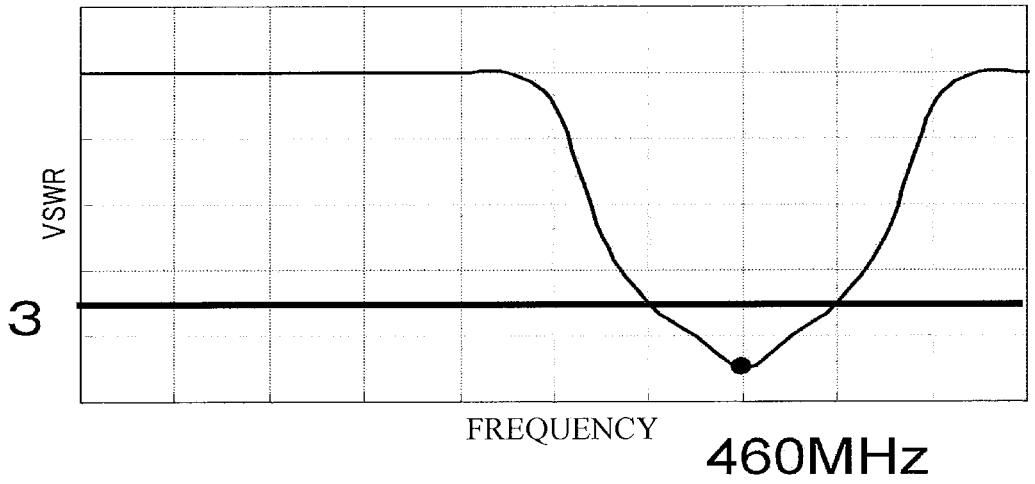
FIGS. 7A and 7B are graphs showing a voltage standing wave ratio with respect to a frequency of an electric wave of the radio device according to Embodiment 2 of the present invention.
Figure 7B:
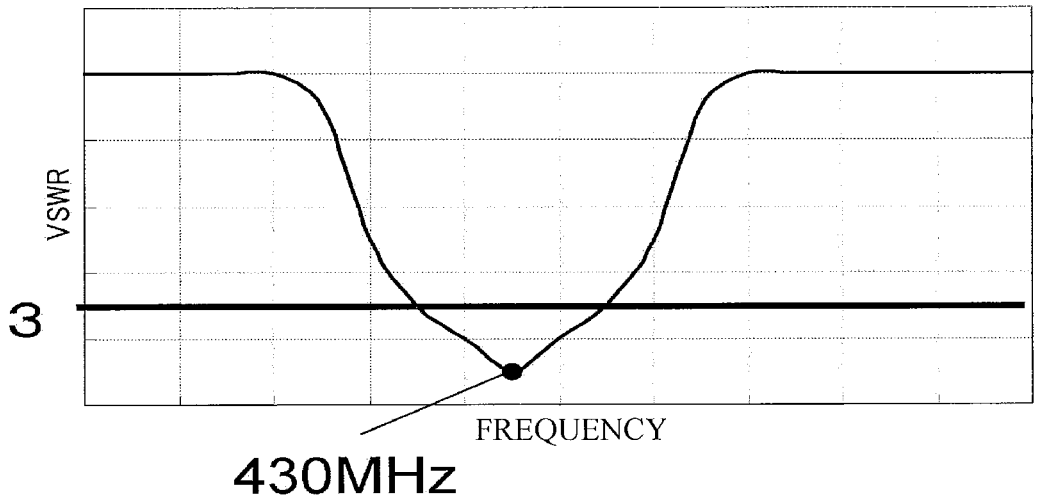

FIG. 7A shows a voltage standing wave ratio (VSWR: Voltage Standing Wave ratio) with respect to the frequency of the electric wave of the radio device 100 as the single unit. FIG. 7B shows a voltage standing wave ratio with respect to the frequency of the electric wave of the radio device 100 attached to the meter box 200.

As shown in FIG. 7A, a resonant frequency of the radio device 100 as the single unit is 460 MHz. By comparison, as shown in FIG. 7B, a resonant frequency of the radio device 100 attached to the meter box 200 is 430 MHz. Thus, when the radio device 100 is attached to the meter box 200, a difference of 30 MHz is generated in the resonant frequency.

However, a bandwidth in which the voltage standing wave ratio in the case where the radio device 100 is attached to the meter box 200 is 3 or less is substantially the same as that in the case of the radio device 100 as the single unit. Thus, when the voltage standing wave ratio is higher, a voltage of a reflected wave is higher when the electric wave is transmitted, and a power efficiency is reduced. Therefore, a practicable voltage standing wave ratio as the antenna is generally 3 or less. A bandwidth in which the voltage standing wave ratio is 3 or less is about 20 MHz in the case of the radio device 100 as the single unit, as shown in FIG. 7A. A bandwidth in which the voltage standing wave ratio is 3 or less is 20 MHz in the case where the radio device 100 is attached to the meter box 200, as shown in FIG. 7B.

In view of the above, when the radio device 100 is attached to the meter box 200, the resonant frequency of the radio device 100 is set to a value which is 30 MHz different from a value of the resonant frequency of the radio device 100 as the single unit. This results in a lowest voltage standing wave ratio and a highest power efficiency. Even if the frequency of the electric wave changes for some reason or other, the voltage standing wave ratio becomes 3 or less so long as the frequency of the electric wave falls within a bandwidth of 20 MHz around the resonant frequency. This applies to the case of the radio device 100 as the single unit, and the case where the radio device 100 is attached to the meter box 200. Therefore, even when the voltage standing wave ratio is high, the radio device 100 attached to the meter box 200 can achieve the radiation efficiency which is substantially equal to that of the radio device 100 as the single unit.

Figure 8:
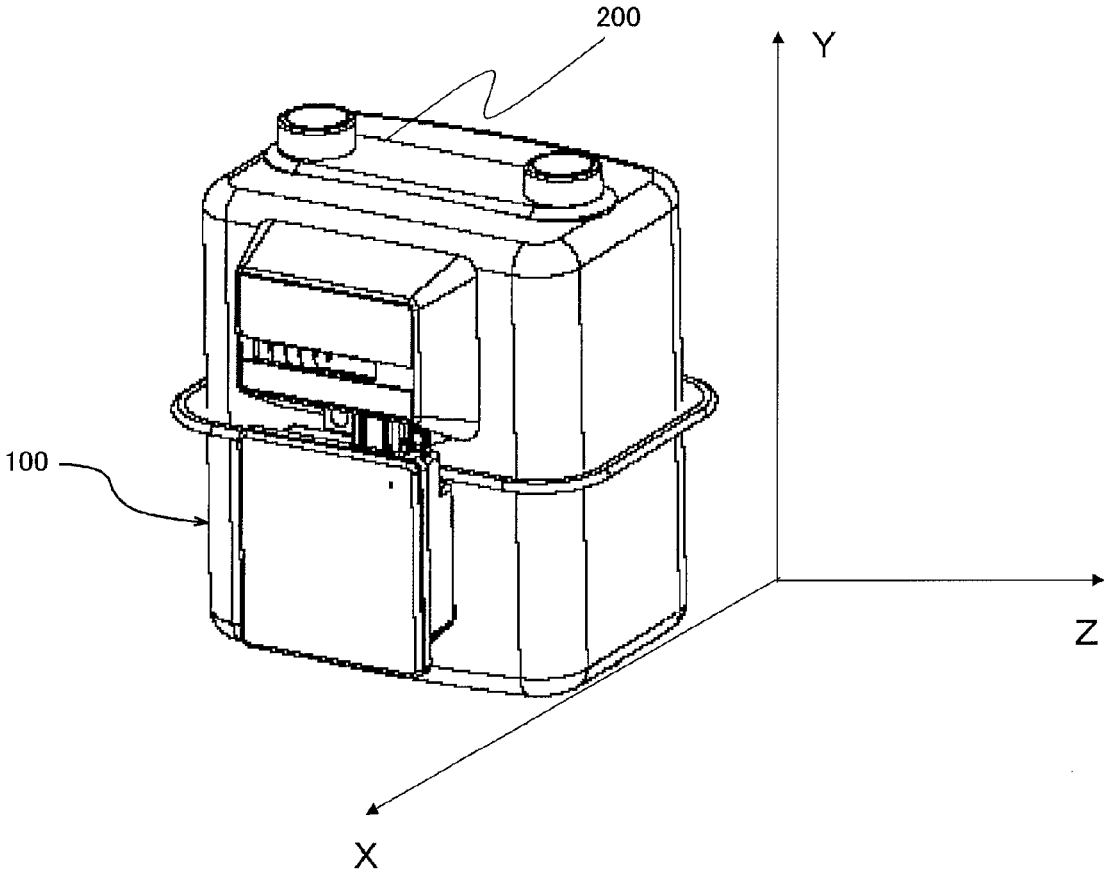
FIG. 8 is a view showing axes in a case where the radio device of Embodiment 2 of the present invention is attached to a meter.
Figure 9:
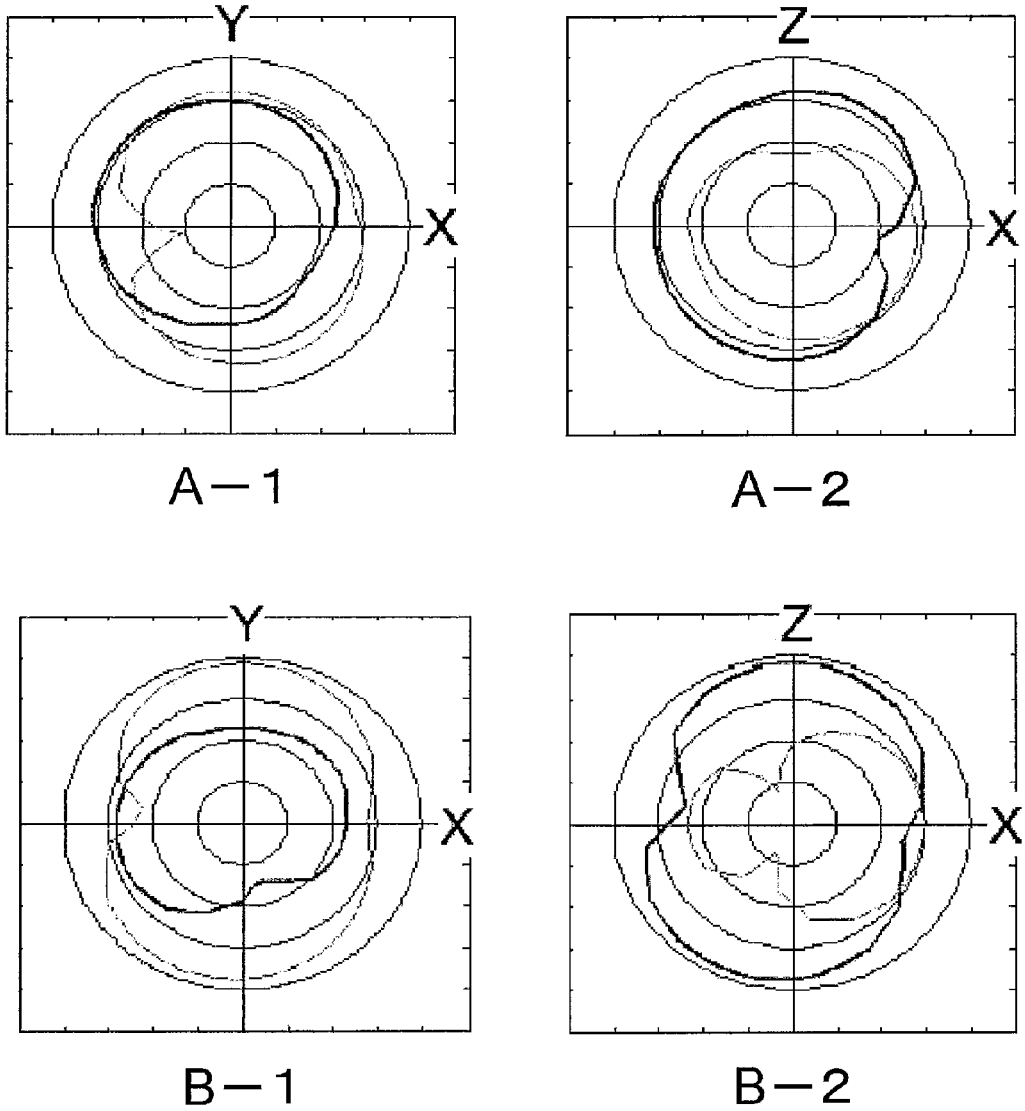
FIG. 9 is a graph showing directional patterns of the radio device according to Embodiment 2 of the present invention.

FIG. 9 shows directional patterns of the radio device 100 in XY-axes and XZ-axes in a case where X-axis, Y-axis, and Z-axis are defined as shown in FIG. 8. In FIG. 9, A-1 indicates a directional pattern in XY-axes direction in a case where the radio device 100 is the single unit, while A-2 indicates a directional pattern in XZ-axes direction in a case where the radio device 100 is the single unit. In FIG. 9, B-1 indicates a directional pattern in XY-axes direction in a case where the radio device 100 is attached to the meter box 200, while A-2 indicates a directional pattern in XZ-axes direction in a case where the radio device 100 is attached to the meter box 200. In each graph, a bold line indicates a vertical polarized wave and a thin line indicates a horizontal polarized wave.

Regarding the XY-axes direction, the vertical polarized wave indicated by B-1 is smaller as compared to the vertical polarized wave indicated by A-1, and thus, the directional pattern of the radio device 100 attached to the meter box 200 is degraded as compared to the directional pattern of the radio device 100 as the single unit. However, the horizontal polarized wave indicated by B-1 is greater than the horizontal polarized wave indicated by A-1, and thus, the directional pattern of the radio device 100 attached to the meter box 200 is significantly improved as compared to the directional pattern of the radio device 100 as the single unit. As a result, as a whole, the directional pattern in XY-axes direction is improved by attaching the radio device 100 to the meter box 200.

Regarding XZ-axes direction, the horizontal polarized wave indicated by A-2 is similar to the horizontal polarized wave indicated by B-2. However, the vertical polarized wave indicated by A-2 is greater than the vertical polarized wave indicated by B-2, and thus, the directional pattern of the radio device 100 attached to the meter box 200 is significantly improved as compared to the directional pattern of the radio device 100 as the single unit.

The radiation efficiency of the radio device 100 as the single unit which is calculated based on the directional patterns is −5 dB, while the radiation efficiency of the radio device 100 attached to the meter box 200 which is calculated based on the directional patterns is −2 dB.

This effect is attained because of the fact that the grounded conductor 103 inside of the radio device 100 is electrically coupled to the obverse wall portion of the metal-made metal box 200, and thereby an effective volume of the antenna increases, by attaching the radio device 100 to the meter box 200. As should be appreciated, by attaching the radio device 100 to the meter box 200, the antenna characteristics such as the directional pattern and the radiation efficiency can be improved.

As described above, in accordance with Embodiment 2, by arranging the radiation conductor 101, the circuit board 102 and the grounded conductor 103 in this order in the thickness direction of the circuit board 102, under a condition in which the size of the radio device 100 is restricted to a small size to allow the radio device 100 to be attached to the meter box 200, it is possible to suppress degradation of the antenna characteristics in the case where the radio device 100 is attached to the metal-made box 200.

That is, it is not preferable that the circuit board 102 or the like is disposed between the radiation conductor 101 and the grounded conductor 103. However, since the radiation conductor 101 and the grounded conductor 103 are disposed with a greatest possible distance between them, the frequency bandwidth of the antenna is expanded, and the antenna characteristics can be improved. In addition, the size of the radio device 100 can be maintained at a small size.

Since the grounded conductor 103 is placed as close to the meter box 200 as possible, the grounded conductor 103 and the meter box 200 are electrically coupled together and serve as the ground of the radiation conductor. Since this ground is greater in size as compared to the wavelength of the electric wave radiated from the radiation conductor, the radio device 100 is less likely to be affected by metal in the vicinity thereof. Therefore, without increasing the size of the grounded conductor 103, it becomes possible to prevent degradation of the antenna characteristics which would be caused by attaching the radio device 100 to the metal-made meter box 200.

In accordance with Embodiment 2, since the radiation conductor 101, the circuit board 102, and the grounded conductor 103 are arranged in parallel with each other, the thickness of the radio device 100 can be reduced.

In accordance with Embodiment 2, since the grounded conductor 103 and the meter box 200 are placed in parallel with each other, they face each other and are spaced apart from each other with a constant and small distance. Therefore, the grounded conductor 103 and the meter box can be electromagnetically coupled together strongly and in a wide range, and thus, it becomes possible to further prevent degradation of the antenna characteristics.

In accordance with Embodiment 2, the radiation conductor 101 is electrically connected to the circuit board 102 via the short-circuit terminal 108 and the power feeding terminal 107, and the grounded conductor 103 is connected to the circuit board 102 via the ground terminal 110. Since the radiation conductor 101 is not directly connected to the grounded conductor 103 in this way, the radiation conductor 101 is away from the metal-made meter box 200 even when the grounded conductor 103 is made closer to the metal-made meter box 200. Because of this, an increase in the impedance of the antenna can be suppressed, and degradation of the antenna characteristics can be prevented.

In accordance with Embodiment 2, the ground terminal 110 is connected the ground section of the circuit board 102, in a location which is in the vicinity of a location at which the short-circuit terminal 108 is grounded on the ground section. Because of this, a distance over which a current flows between these locations can be reduced, an increase in the impedance of the antenna can be suppressed, and degradation of the antenna characteristics can be prevented.

Embodiment 3

In Embodiment 2, the grounded conductor 103 is used as the ground of the radiation conductor 101. By comparison, in Embodiment 3, a ground layer 123 of a circuit board 120 serves as the ground (grounded conductor) of the radiation conductor 101.

Figure 10B:
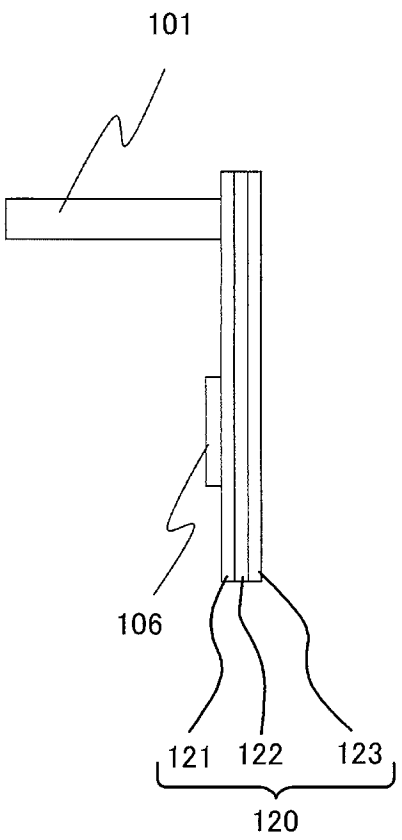
FIGS. 10A and 10B are schematic views showing a radiation conductor, and a circuit board in a radio device according to Embodiment 3 of the present invention.
Figure 10A:
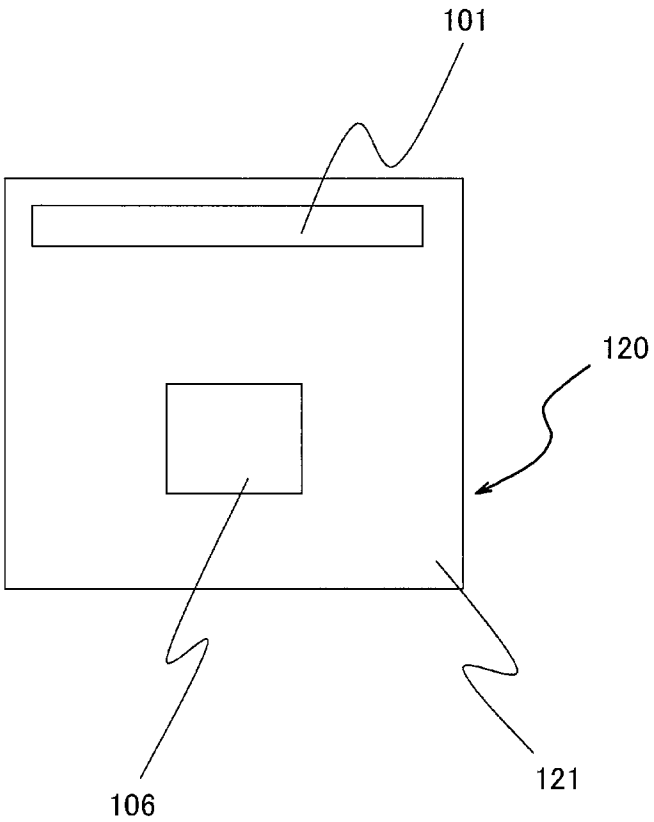

FIG. 10A is a front view of the radiation conductor 101 and the circuit board 120. FIG. 10B is a side view of the radiation conductor 101 and the circuit board 120.

The radiation conductor 101 and the radio circuit 106 are mounted on the circuit board 120. The circuit board 120 includes multiple layers. The circuit board 120 is configured such that layers provided with electric conductor wires are stacked on an insulator board (substrate). The circuit board 120 includes a first circuit layer 121, a second circuit layer 122, and the ground layer 123. The first circuit layer 121 and the second circuit layer 122 constitute a circuit for performing radio (wireless) transmission/reception and are formed on a main surface of a pair of main surfaces of the circuit board 120, which main surface is closer to the radiation conductor 101. The ground layer 123 comprises a conductor layer made of an electric conductor such as metal. The ground layer 123 is formed as a grounded conductor on a main surface of the pair of main surfaces of the circuit board 120, which main surface is more distant from the radiation conductor 101, and constitutes a ground of the radiation conductor 101.

In this case, the circuit board 120 is placed inside the first casing 104*a* such that the ground layer 123 faces the back surface of the first casing 104*a*, and the opening of the first casing 104*a* is closed by the second casing 104*b*.

In Embodiment 3 configured as described above, in a state in which the back surface of the first casing 104*a* of the radio device 100 is placed on the obverse wall portion of the metal-made meter box 200, the ground layer 123 of the circuit board 120 faces the obverse wall portion such that the ground layer 123 is parallel to the obverse wall portion. Since the distance between the ground layer 123 and the obverse wall portion is small, the ground layer 123 is electrically coupled to the obverse wall portion (by electrostatic capacitance). This allows the ground layer 123 and the obverse wall portion to serve as the ground of the radiation conductor 101, which increases the effective area of the antenna. Therefore, the radio device 100 is less likely to be affected by metal in the vicinity thereof, and thus degradation of the radiation characteristic due to the metal in the vicinity thereof can be prevented. In addition, in the radio device 100 used in a low frequency band, a ground which is great in size need not be provided inside the radio device 100, and thus, the radio device 100 incorporating the antenna with a high radiation characteristic can be reduced in size.

In accordance with Embodiment 3, since one of the multiple layers of the circuit board 120 having the multilayer structure is used as the ground of the radiation conductor 101, it is not necessary to provide the ground of the radiation conductor 101 separately. Therefore, the size of the radio device 100 can be reduced, the number of components can be reduced, and manufacturing cost can be reduced.

Embodiment 4

Embodiment 4 is identical to Embodiment 2 except for a shape of a first casing and a shape of a second casing.

Figure 11:
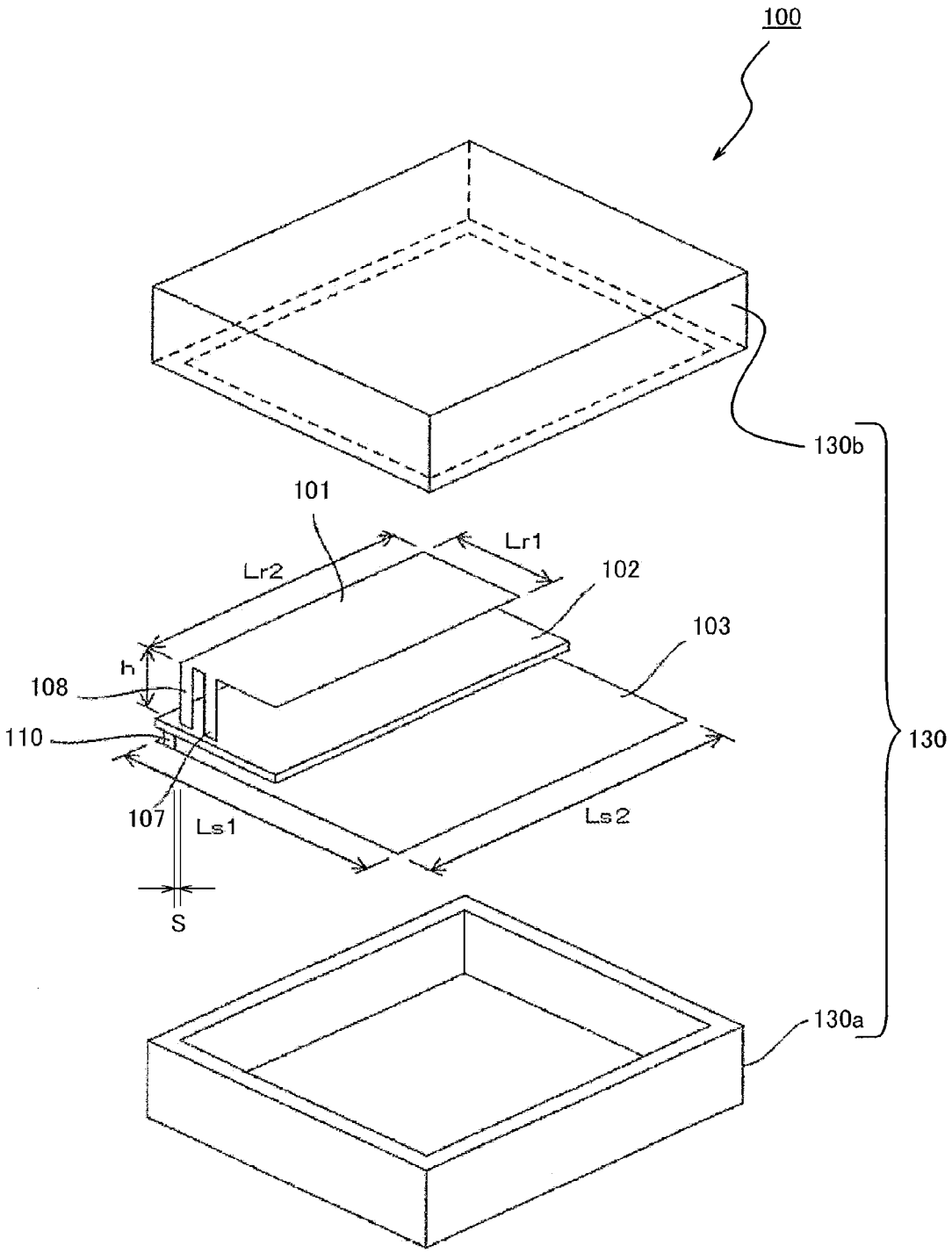
FIG. 11 is an exploded perspective view showing a radio device according to Embodiment 4 of the present invention.

FIG. 11 is an exploded perspective view showing the radio device 100. For the sake of convenience, a battery and a radio circuit are omitted.

Each of a first casing 130*a* and a second casing 130*b* of a casing 130 has a container shape having an opening. For example, the first casing 130*a* and the second casing 130*b* are made of resin such as polypropylene or ABS, having a low-loss property with respect to the electric wave. The first casing 130*a* is equal in size to the second casing 130*b*. The first casing 130*a* and the second casing 130*b* are joined together and fastened together by means of screws, bonding or fusion-bonding in a state in which the opening of the first casing 130*a* and the opening of the second casing 130*b* are aligned with respect to each other.

The circuit board 102, the radiation conductor 101, the power feeding terminal 107, the short-circuit terminal 108, the grounded conductor 103 and the ground terminal 110 are the same as those of Embodiment 2.

Nonetheless, the location of the power feeding terminal 107 and the location of the short-circuit terminal 108 are different from those of Embodiment 2. In Embodiment 2 and Embodiment 4, the short-circuit terminal 108 and the power feeding terminal 107 are arranged in parallel with each other and located at the end of the radiation conductor 101 and the end of the circuit board 102, and a distance between the short-circuit terminal 108 and the power feeding terminal 107 is set to a value which enables impedance matching between the radiation conductor 101 and the radio circuit 106. So long as these conditions are satisfied, the location of the power feeding terminal 107 and the location of the short-circuit terminal 108 are not limited to those of Embodiment 4, in Embodiment 2.

The location of the ground terminal 110 is different between Embodiment 2 and Embodiment 4. In Embodiment 2 and Embodiment 4, the ground terminal 110 is located at the end of the circuit board 102 and the end of the grounded conductor 103, and connected to the circuit board 102 in the vicinity of the location at which the short-circuit terminal 108 is grounded on the circuit board 102. Therefore, so long as this condition is satisfied, the location of the ground terminal 110 is not limited to those of Embodiment 2 and Embodiment 4.

Figure 12B:
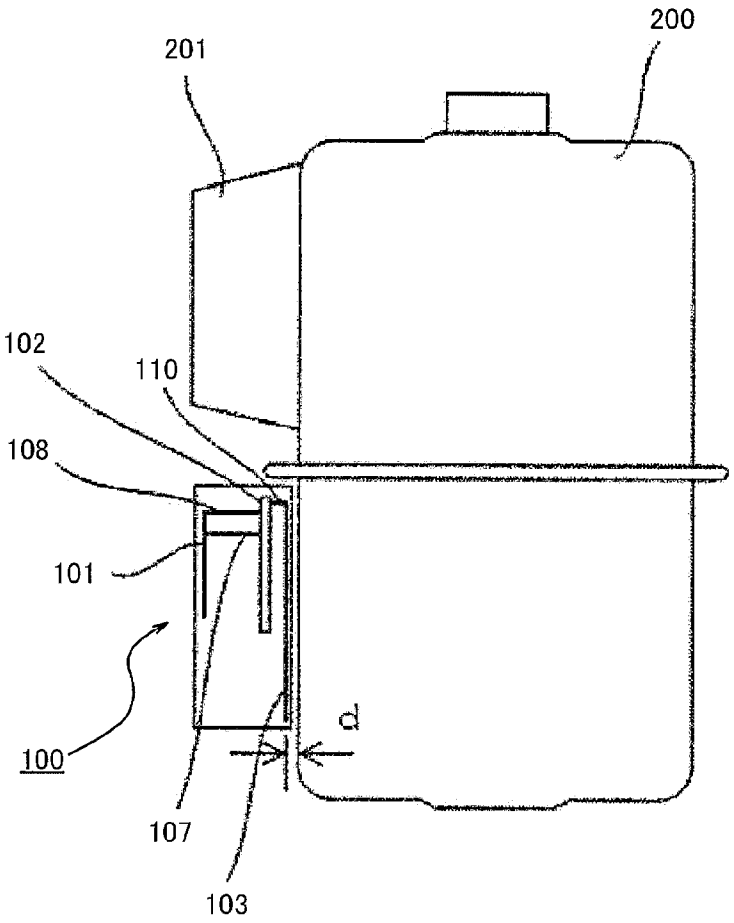
FIGS. 12A and 12B are schematic views showing a state in which a radio device according to Embodiment 4 of the present invention is attached to a meter box.
Figure 12A:
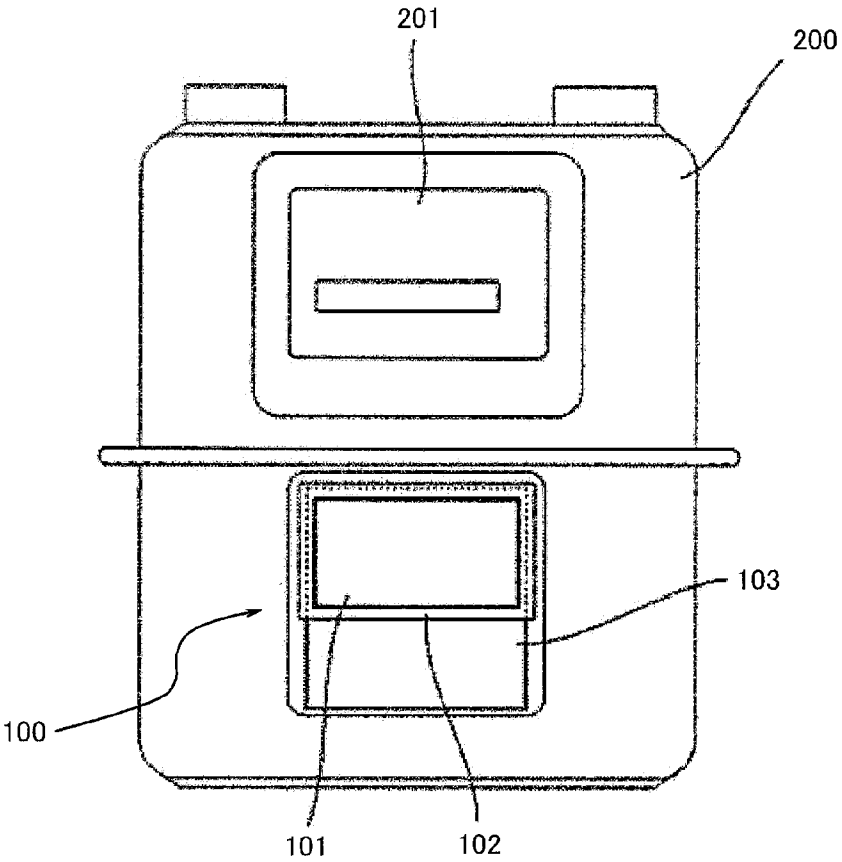

FIG. 12A is a front view showing a state in which the radio device 100 is attached to the meter box 200 and FIG. 12B is a side view of FIG. 12A. In FIG. 12A, the first casing 130*a* is omitted for the sake of convenience.

The radio device 100 including a planar inverted-F antenna is attached to the obverse wall portion of the meter box 200. An operating frequency of the planar inverted-F antenna is set to, for example, 433 MHz.

The meter box 200 is a metal-made measuring device for measuring, for example, a flow rate of gas and has a rectangular-parallelepiped shape. The size of the meter box 200 is set to, for example, a length of 200 mm (0.289 wavelength), a width of 200 mm (0.289 wavelength) and a thickness of 100 mm (0.144 wavelength).

In the radio device 100, a length Lr1 of the radiation conductor 101 is set to 45 mm (0.065 wavelength), and a width Lr2 of the radiation conductor 101 is set to 66 mm (0.095 wavelength). A length Ls1 of the grounded conductor 103 is set to 62 mm (0.089 wavelength), and a width Ls2 of the grounded conductor 103 is set to 66 mm (0.095 wavelength). A distance "h" between the circuit board 102 and the radiation conductor 101 is set to 18.5 mm (0.027 wavelength), and a planar distance "s" between the short-circuit terminal 108 and the ground terminal 110 is set to 5 mm (0.007 wavelength).

The radio device 100 is placed under the display section 201 attached to the obverse wall portion of the meter box 200. In this case, since the radio device 100 is placed such that the back surface of the first casing 130*a* faces the obverse wall portion of the meter box 200, the grounded conductor 103 is in close proximity to the meter box 200. A distance "d" is provided between the back surface of the first casing 130*a* and the obverse wall portion of the meter box 200. The distance "d" is set to, for example, 1/50 wavelength or less. Because of the small distance "d," the grounded conductor 103 is electrically capacitively-coupled to the meter box 200, and it is supposed that the grounded conductor 103 has an electric potential equal to that of the meter box 200 in terms of a radio frequency (RF). Therefore, the meter box 200 as well as the grounded conductor 103 serves as the ground of the planar inverted-F antenna. As a result, in the small-sized radio device 100, a great ground area can be ensured, and a high radiation efficiency can be achieved.

Figure 13:
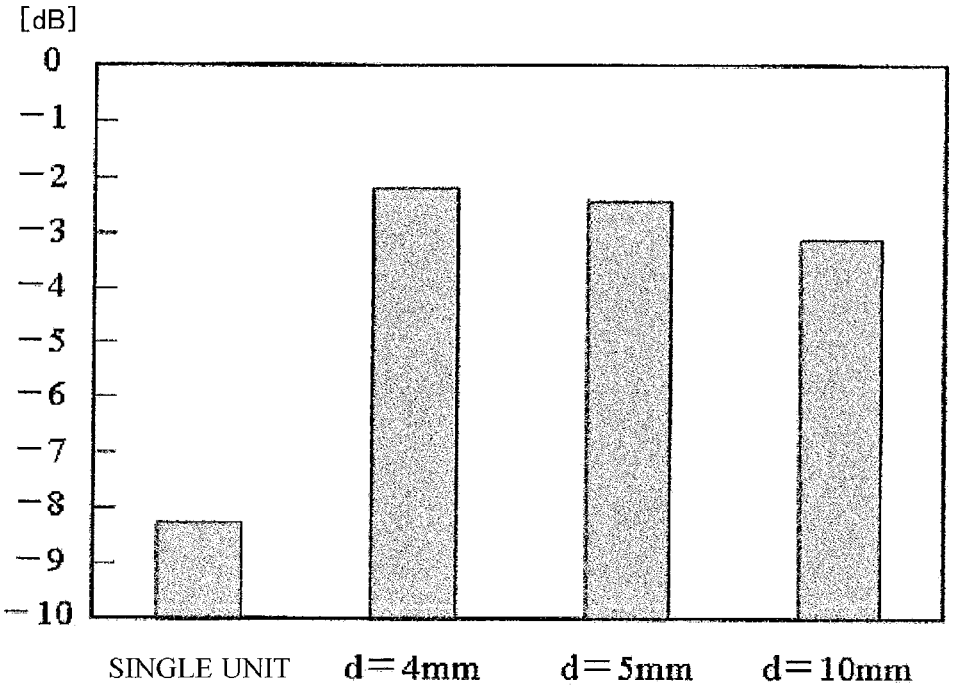
FIG. 13 is a graph showing the relationship between a radiation efficiency of the radio device according to Embodiment 4 of the present invention and a distance "d" between the radio device and the meter box.

FIG. 13 shows a gain of the radio device 100 as a single unit and a gain of the radio device 100 attached to the meter box 200 with respect to the distance "d." In FIG. 13, a vertical axis indicates a gain of the planar inverted-F antenna. Note that values other than the distance "d" are identical to those shown in FIGS. 12(A) and 12(B).

The gain of the radio device 100 as the single unit is about—8 dB, while the gain of the radio device 100 attached to the meter box 200 is about—3 dB or greater. From this, it can be understood that the gain is improved by 5 dB or greater by attaching the radio device 100 to the meter box 200. It is presumed that this is due to the fact that the meter box 200 and the grounded conductor 103 are electrically capacitively-coupled together and the area of the ground of the planar inverted-F antenna increases.

The gain decreases as the distance "d" between the radio device 100 and the meter box 200 increases, like 4 mm, 5 mm, and 10 mm. The gain decreases by 0.2 dB every time the distance "d" increases by 1 mm (0.001 wavelength). By placing the grounded conductor 103 as close to the meter box 200 as possible, a coupling capacitance between them increases, and thus, the gain can be improved.

Figure 14:
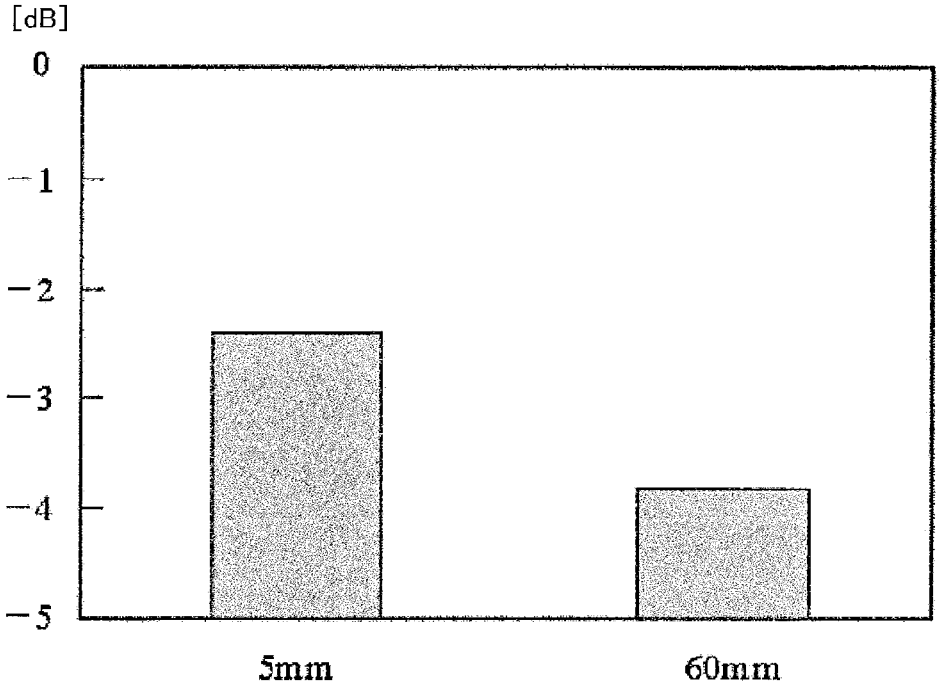
FIG. 14 is a graph showing the relationship between the radiation efficiency of the radio device according to Embodiment 4 of the present invention and a distance "s" between a short-circuit terminal and a ground (earth) terminal.

FIG. 14 shows the relationship between the planar distance "s" between the short-circuit terminal 108 and the ground terminal 110 and the gain of the planar inverted-F antenna in the case where the radio device 100 is attached to the meter box 200. In FIG. 14, a vertical axis indicates the gain of the planar inverted-F antenna. Values other than the planar distance "s" are identical to those shown in FIGS. 12(A) and 12(B).

When the planar distance "s" between the short-circuit terminal 108 and the ground terminal 110 is 5 mm (0.007 wavelength), the gain is about—2.5 dB. When the planar distance "s" is 60 mm, the gain is about—4 dB. From this, it can be understand that the gain increases as the distance "s" decreases. It is presumed that this is due to the fact that with an increase in the distance "s" between the location at which the short-circuit terminal 108 is connected to the circuit board and the location at which the ground terminal 110 is connected to the circuit board, a current flow in the circuit board 102 changes in such a way that a current distribution in the grounded conductor 103 changes and a radiation resistance is lowered.

As described above, in accordance with Embodiment 4, by placing the radio device 100 close to the meter box 200 to allow the grounded conductor 103 to be electrically capacitively-coupled to the meter box 200, the antenna characteristics are improved as compared to those in the case of the radio device 100 as the single unit. In particular, as the distance between the radio device 100 and the meter box 200 is set smaller, the antenna characteristics are further improved.

In accordance with Embodiment 4, by placing the ground terminal 110 in the vicinity of the location at which the short-circuit terminal 108 is grounded on the circuit board 102, excellent antenna characteristics are attained. Especially as the planar distance "s" between the short-circuit terminal 108 and the ground terminal 110 in the circuit board 102 is smaller, the antenna characteristics are further improved.

In accordance with Embodiment 4, like Embodiment 2, by arranging the radiation conductor 101, the circuit board 102, the grounded conductor 103 and the obverse wall portion of the meter box 200 in this order in parallel with each other, excellent antenna characteristics are attained in the small-sized radio device 100. Since the radiation conductor 101 is electrically connected to the circuit board 102 via the short-circuit terminal 108 and the power feeding terminal 107, and the grounded conductor 103 is connected to the circuit board 102 via the ground terminal 110, degradation of the antenna characteristic can be prevented.

Embodiment 5

In Embodiment 4, the first casing 130*a* and the second casing 130*b* are fastened together by means of the screws, bonding, fusion-bonding, or the like, whereas in Embodiment 5, the first casing 130*a* and the second casing 130*b* are fastened together by means of fusion-bonding using a conductor element 132. In other respects, Embodiment 5 is the same as Embodiment 2 and Embodiment 4.

Figure 15:
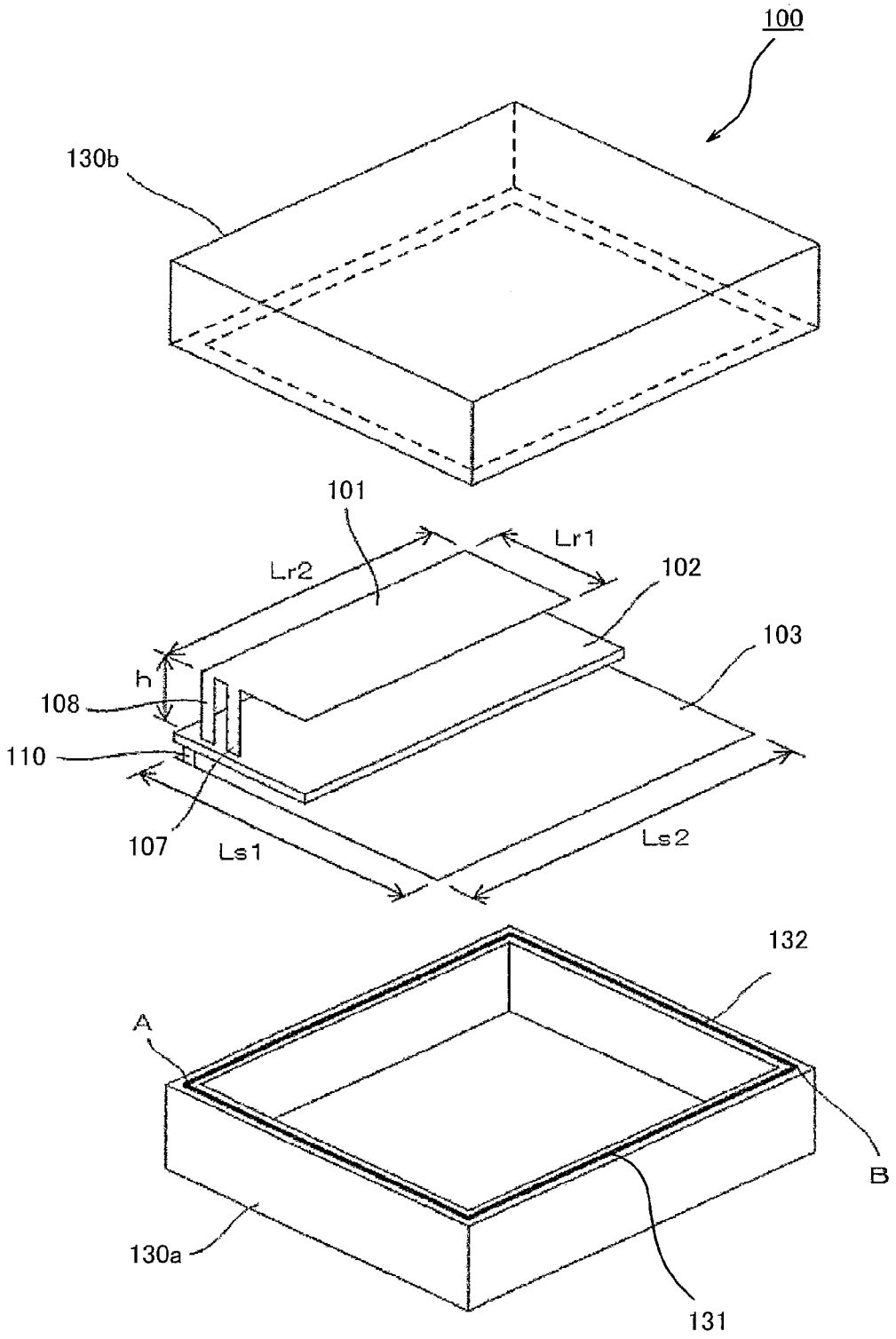
FIG. 15 is an exploded perspective view showing a radio device according to Embodiment 5 of the present invention.

FIG. 15 is an exploded perspective view showing the radio device 100. For the sake of convenience, the battery is omitted.

The first casing 130*a* has a groove 131 on a surface joined to the second casing 130*b*. The groove 131 is provided to enclose the opening of the first casing 130*a*. The conductor element 132 is fitted into the groove 131. The conductor element 132 is a linear element made of a metal conductor such as iron or copper. Both ends of the conductor element 132 are connected together, and thus, the conductor element 132 has an annular shape.

When a current is applied in a direction from point A to point B of the conductor element 132, in a state in which the second casing 130*b* is joined to the first casing 130*a* attached with the conductor element 132, the conductor element 132 generates heat because of a resistance of the conductor element 132. By the heat generated in the conductor element 132, a surface of the first casing 130*a* and a surface of the second casing 130*b* which are joined together are melted, and the first casing 130*a* and the second casing 130*b* are fusion-bonded, thereby forming the casing 130. In this state, the casing 130 is sealed.

When the radio frequency (RF) signal is applied to the radiation conductor 101, in the radio device 100 configured as described above, the radiation conductor 101 is electrically coupled to the conductor element 132 present in the vicinity of thereof. Thereby, the conductor element 132 is utilized as a radiation element, and the effective area of the antenna increases. As a result, antenna performance can be further improved.

In accordance with Embodiment 5, the casing 130 of the radio device 100 is sealed so that the interior of the radio device 100 is isolated from air and water. Therefore, the radiation conductor 101, the grounded conductor 103, and the like, are not oxidized, and a change in the impedance of the radiation conductor 101 is prevented. As a result, stable antenna characteristics can be maintained.

In accordance with Embodiment 5, since the conductor element 132 used to fusion-bond the first and second casings 130*b* together is placed in the vicinity of the radiation conductor 101, they are electrically coupled together. As a result, radiation performance of the radiation conductor 101 is improved.

In accordance with Embodiment 5, like the above embodiments, by placing the radio device 100 in the vicinity of the meter box 200, the antenna characteristics can be improved. Since the radiation conductor 101, the circuit board 102, the grounded conductor 103 and the obverse wall portion of the meter box 200 are arranged in this order and in parallel with each other, excellent antenna characteristics are attained in the small-sized radio device 100. By disposing the ground terminal 110 in the vicinity of the location at which the short-circuit terminal 108 is grounded on the circuit board 102, excellent antenna characteristics are attained. Since the radiation conductor 101 is electrically connected to the circuit board 102 via the short-circuit terminal 108 and the power feeding terminal 107 and the grounded conductor 103 is connected to the circuit board 102 via the ground terminal 110, degradation of the antenna characteristics can be prevented.

In Embodiment 2, the recessed first casing 130*a* and the second casing 130*b* of the flat-plate shape are used, while in Embodiment 4, the recessed first casing 130*a* and the recessed second casing 130*b* are used. The shape of the first casing 130*a* and the shape of the second casing 130*b* are not limited to those shapes so long as the first casing 130*a* and the second casing 130*b* accommodate the components such as the radiation conductor 101. For example, the first casing 130*a* may have the flat-plate shape and the second casing 130*b* may be recessed.

Although in Embodiment 5, the first casing 130*a* and the second casing 130*b* are fusion-bonded by using the linear conductor element 132, the first casing 130*a* and the second casing 130*b* may be fastened together by using the linear conductor element 132, in other embodiments in the same manner.

Figure 16A:
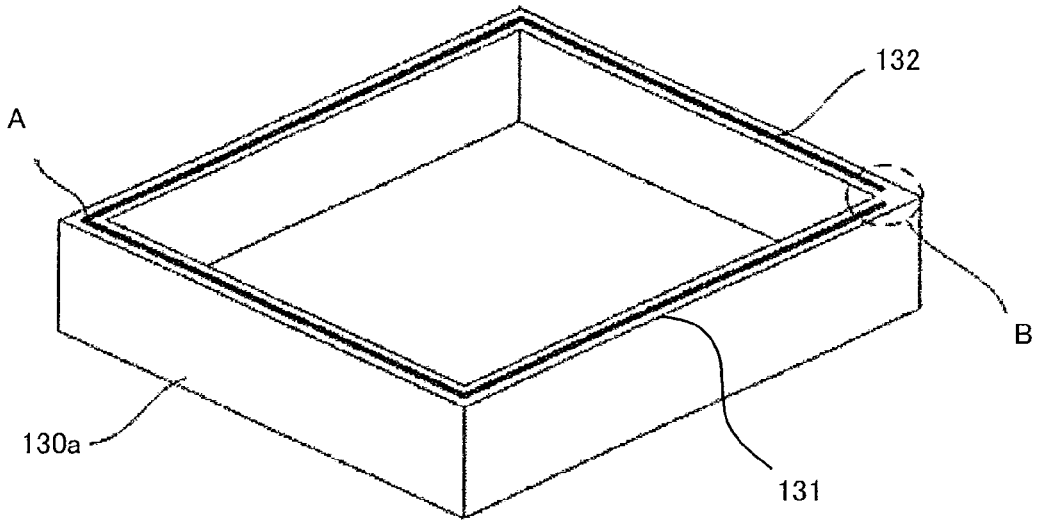
FIGS. 16A and 16B are perspective views showing another configuration of a conductor element incorporated into a radio device according to Embodiment 5 of the present invention.
Figure 16B:
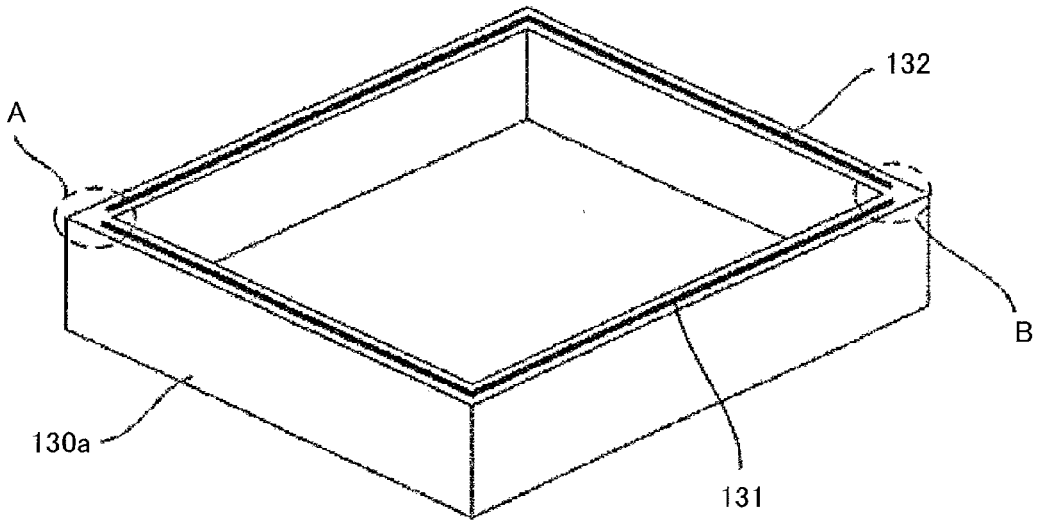

Although in Embodiment 5, the conductor element 132 has an annular shape connecting both ends together, the present invention is not limited to this. For example, as shown in FIG. 16A, one gap may be provided in the conductor element 132 in such a way that the both ends of the conductor element 132 are not connected together but are open. Or, as shown in FIG. 16B, two conductor elements 132 may be spaced apart from each other such that two gaps are provided in the conductor element 132. By setting the length of the conductor element 132 to the resonant frequency, the conductor element 132 can be electrically coupled to the radiation conductor 101.

Although in Embodiment 4 and Embodiment 5, the grounded conductor 103 is used as the ground of the radiation conductor 101, the ground layer 123 of the circuit board 102 can be used as the ground of the radiation conductor 101, like Embodiment 3.

Although in Embodiment 2, Embodiment 4 and Embodiment 5, the planar inverted-F antenna is used as the radiation conductor 101, the radiation conductor 101 may comprise another planar conductor element 132. For example, a linear inverted-L antenna, a planar dipole antenna, or the like may be used as the planar conductor element.

Although in all of the above embodiments, the conductors of the flat-plate shape are used as the radiation conductor 101 and the grounded conductor 103, a linear conductor element, or a metal-foil wire on the circuit board may be used as the radiation conductor.

Figure 18:
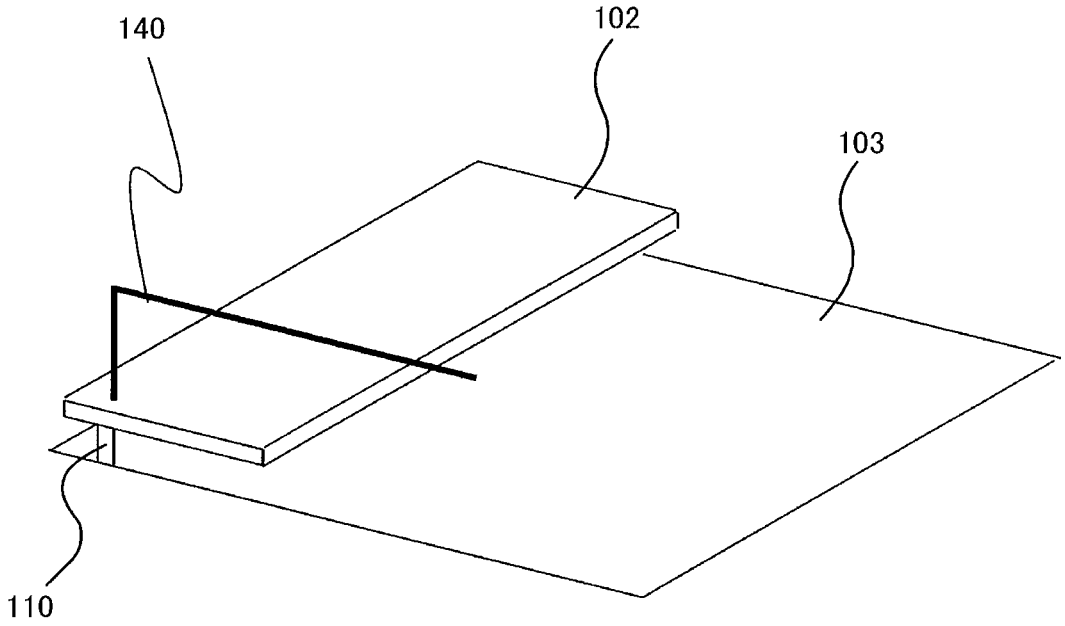
FIG. 18 is a perspective view showing a circuit board and a grounded conductor in a radio device according to another embodiment of the present embodiment.

As the linear conductor element, there are linear antennas such as a dipole antenna, a loop antenna, and a meander line antenna. In this case, as shown in FIG. 18, a radiation conductor 140 of a linear conductor element is electrically connected to the circuit board 102. The radiation conductor 140 extends vertically from the circuit board 102, is bent at a right angle and then extends in parallel with the circuit board 102. Therefore, the radiation conductor 140, the circuit board 102 and the grounded conductor 103 are placed in this order in parallel in the thickness direction of the circuit board 102.

Figure 19B:
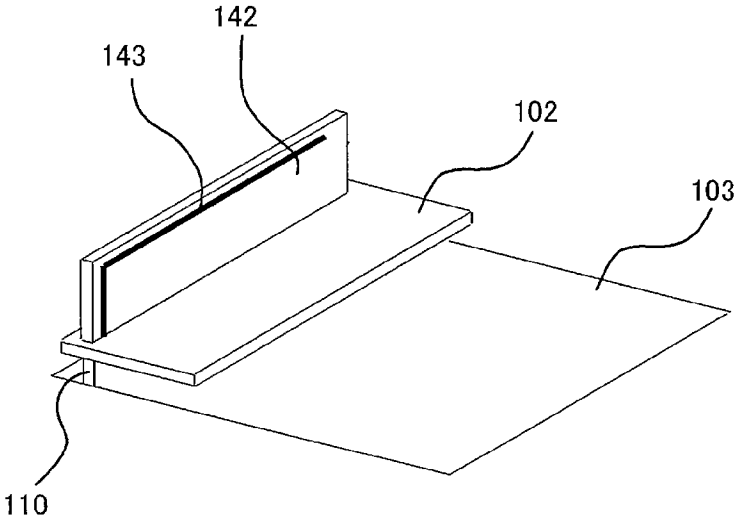
FIGS. 19A and 19B are perspective views showing a circuit board and a grounded conductor in a radio device according to still another embodiment of the present embodiment.
Figure 19A:
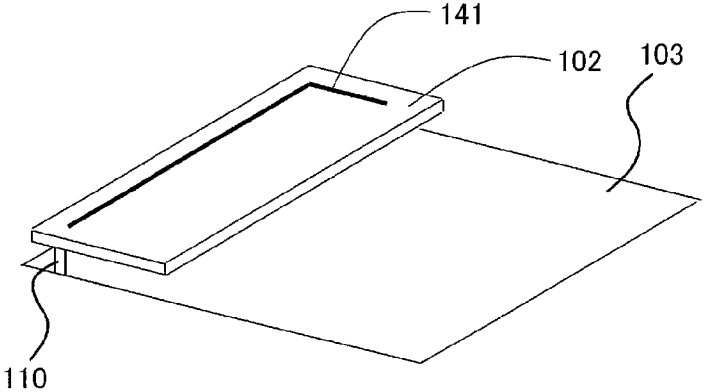

In the case where the metal-foil wire on the circuit board is used as the radiation conductor, a circuit board 102 having a multi-layer structure is used as shown in FIG. 19A. The circuit board 102 has a circuit layer and a radiation conductor layer. A metal-foil wire 141 appearing on the obverse surface of the circuit board 102 serves as the layer of the radiation conductor. In this case, also, the metal-foil wire 141, the circuit layer of the circuit board 102, and the grounded conductor 103 are arranged in this order in parallel. In this case, the number of components is reduced, the size of the radio device is reduced, and manufacturing cost is not increased.

In the case where the metal-foil wire on the circuit board is used as the radiation conductor, two circuit boards, which are the circuit board 102 and a circuit board 142 are used, as shown in FIG. 19B. The circuit board 142 is placed to extend vertically with respect to the circuit board 102, and a metal-foil wire 143 is provided on the surface thereof. The metal-foil wire 143 serves as the radiation conductor. The metal-foil wire 143 extends vertically with respect to the circuit board 102, is bent vertically, and then extends in parallel with the circuit board 102. Therefore, the metal-foil wire 143, the circuit board 102 and the grounded conductor 103 are placed in this order in parallel with each other.

Moreover, in all of the above embodiments, the circuit board 102 may comprise a multi-layer board, a double-sided board or a single-sided board, in view of a circuit scale or reliability.

The description is to be construed as illustrative only, and is provided for the purpose of teaching those skilled in the art the best mode of carrying out the invention. The details of the structure and/or function may be varied substantially without departing from the spirit of the invention.

INDUSTRIAL APPLICABILITY

As described above, the radio device 100 of the present invention has an advantage that a high radiation efficiency is achieved irrespective of its small-sized structure, in a state in which the radio device 100 is attached to the meter formed by the metal casing 130, and is useful as the radio device 100 for automatic meter reading system such as the meter box 200.

The invention claimed is:

1. A radio device for attachment to a meter box having a planar obverse wall made of metal, the radio device comprising:

a radiation conductor which converts a radio frequency signal into an electric wave and radiates the electric wave;

a circuit board electrically connected to the radiation conductor and incorporating an electric circuit for supplying the radio frequency signal to the radiation conductor;

a planar grounded conductor electrically connected to the electric circuit on the circuit board and placed such that the grounded conductor faces the radiation conductor and faces the planar obverse wall of the meter box upon attachment of the radio device to the meter box, the planar grounded conductor constituting a ground of the radiation conductor, the planar grounded conductor facing the planar obverse wall of the meter box to be spaced apart by a distance d from the surface of the meter box upon attachment of the radio device to the meter box such that the planar grounded conductor and the planar obverse wall of the meter box are electrically capacitively joined together and are substantially parallel, such that the planar grounded conductor and the planar obverse wall of the meter box cooperate as an enlarged ground plane of the radiation conductor to prevent or reduce increase in impedance between the radiation conductor and the planar grounded conductor upon attachment of the radio device to the meter box; and a resin-made casing sized to surroundingly contain the radiation conductor, the circuit board and the planar grounded conductor;

wherein the planar grounded conductor, the circuit board and the radiation conductor are placed in this order along a linear axis in a thickness direction of the circuit board.

2. The radio device according to claim 1, wherein the grounded conductor and a surface of the casing which faces the grounded conductor are placed in parallel with each other.

3. The radio device according to claim 1, wherein the radiation conductor, the grounded conductor and the circuit board are placed in parallel with each other.

4. The radio device according to claim 1, wherein the radiation conductor comprises a planar conductor element.

5. The radio device according to claim 4, wherein the radiation conductor comprises a planar inverted-F antenna.

6. The radio device according to claim 1, further comprising:

a power feeding terminal which electrically connects the electric circuit on the circuit board to the radiation conductor and feeds the radio frequency signal from the circuit board to the radiation conductor;

a short-circuit terminal which electrically connects a ground section of the electric circuit on the circuit board to the radiation conductor and electrically grounds the radiation conductor on the ground section of the electric circuit; and a ground terminal which electrically connects the grounded conductor to the ground section of the electric circuit on the circuit board and is placed on the ground section, in the vicinity of a location at which the short-circuit terminal is grounded on the ground section.

7. The radio device according to claim 1, wherein the radiation conductor comprises a wire formed on a main surface of an obverse surface and a reverse surface of the circuit board, the main surface being more distant from the grounded conductor.

8. The radio device according to claim 1, wherein the radiation conductor comprises a linear conductor element.

9. The radio device according to claim 1, wherein a conductor layer which is the grounded conductor is provided on a main surface of an obverse surface and a reverse surface of the circuit board, the main surface being more distant from the radiation conductor.

10. The radio device according to claim 9, wherein a layer including the electric circuit is provided on a main surface of the obverse surface and the reverse surface of the circuit board, the main surface being closer to the radiation conductor.

11. The radio device according to claim 1, wherein the casing includes a container-shaped body having an opening and a lid closing the opening of the body;

wherein a linear conductor element is placed on one of the body and the lid such that the linear conductor element encloses the opening; and wherein the radiation conductor, the circuit board and the grounded conductor are accommodated into the body such that the radiation conductor is positioned in the vicinity of the opening.

12. The radio device of claim 1 wherein, when the radio device is attached to the meter box, the planar grounded conductor is closer to the planar obverse wall of the meter box than the radiation conductor so that, even if the size of the grounded conductor is small with respect to a wavelength of the radio frequency signal, decrease in the impedance between the radiation conductor and the planar grounded conductor is prevented or reduced when the radio device is attached to the meter box.

13. The radio device of claim 1 wherein the radio device and the meter box are configured to place the planar grounded conductor close enough to the planar obverse wall of the meter box to increase coupling capacitance between the planar grounded conductor and the planar obverse wall of the meter box to increase antenna gain of the radio device.

14. The radio device of claim 1 wherein the distance d is set to 1/50 or less of a wavelength of interest.

15. The radio device of claim 1 wherein the resin made casing comprises:

a first casing having a container shape having an opening; and a second casing configured to close the opening of the first casing when the radiation conductor, the circuit board and the grounded conductor are contained in the casing.

16. The radio device of claim 15 wherein each of the first casing and the second casing are made of a resin having a low-loss property with respect to the electric wave.

* * * * *